US008562496B2

(12) United States Patent
Webber et al.

(10) Patent No.: US 8,562,496 B2
(45) Date of Patent: Oct. 22, 2013

(54) THIGH EXERCISE MACHINE WITH ROCKING USER SUPPORT

(75) Inventors: Randall T. Webber, La Jolla, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 189 days.

(21) Appl. No.: 13/039,824

(22) Filed: Mar. 3, 2011

(65) Prior Publication Data

US 2011/0224058 A1 Sep. 15, 2011
US 2012/0100970 A9 Apr. 26, 2012

Related U.S. Application Data

(60) Provisional application No. 61/310,884, filed on Mar. 5, 2010.

(51) Int. Cl.
*A63B 21/00* (2006.01)
*A63B 21/068* (2006.01)

(52) U.S. Cl.
USPC ..... 482/133; 482/96

(58) Field of Classification Search
USPC ..... 482/133, 93, 96, 100, 122, 131, 135, 482/138, 146, 147, 148
See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 3,116,062 | A | 12/1963 | Zinkin |
| 3,446,503 | A | 5/1969 | Lawton |
| 3,592,465 | A | 7/1971 | Fulkerson, Jr. |
| 3,640,528 | A | 2/1972 | Proctor |
| 3,707,285 | A | 12/1972 | Martin |
| 3,917,262 | A | 11/1975 | Salkeld |
| 4,004,801 | A | 1/1977 | Campanaro et al. |
| 4,111,414 | A | 9/1978 | Roberts |
| 4,149,714 | A | 4/1979 | Lambert, Jr. |

(Continued)

FOREIGN PATENT DOCUMENTS

| | | |
|---|---|---|
| CA | 2075331 | 2/1994 |
| GB | 2162075 | 1/1986 |
| SU | 1674874 | 9/1991 |

OTHER PUBLICATIONS

Polaris Adductor, 1986, 1 page.

(Continued)

*Primary Examiner* — Loan Thanh
*Assistant Examiner* — Shila Jalalzadeh Abyane
(74) *Attorney, Agent, or Firm* — Procopio Cory Hargreaves & Savitch LLP

(57) ABSTRACT

A thigh exercise machine has a stationary main frame, a pivotally mounted user support seat, and a pair of exercise arms mounted for rotation between inner and outer positions, each arm having a pad positioned to engage part of a user's leg such as a user's inner or outer thigh. A connecting linkage translates movement of the exercise arms into rocking movement of the user support seat. The connecting linkage is arranged so that user is positioned in an upright or slightly reclined posture when their legs are together and a more reclined posture when their legs are spread apart.

31 Claims, 20 Drawing Sheets

(56) References Cited

U.S. PATENT DOCUMENTS 4,231,568 A 11/1980 Riley et al.
4,240,627 A * 12/1980 Brentham ..... 482/112
4,300,760 A 11/1981 Bobroff
4,336,934 A 6/1982 Hanagan et al.
4,390,179 A 6/1983 Szkalak
4,441,708 A 4/1984 Brentham
4,448,412 A 5/1984 Brentham
4,468,025 A 8/1984 Sferle
4,478,411 A * 10/1984 Baldwin ..... 482/136
4,511,137 A 4/1985 Jones
4,577,861 A 3/1986 Bangerter et al.
4,598,907 A 7/1986 Ross
4,632,390 A 12/1986 Richey
4,641,833 A 2/1987 Trethewey
4,678,185 A 7/1987 Mahnke
4,684,126 A 8/1987 Dalebout et al.
4,700,946 A 10/1987 Breunig
4,743,010 A 5/1988 Geraci
4,790,530 A 12/1988 Maag
4,793,608 A 12/1988 Mahnke et al.
4,822,038 A 4/1989 Maag
D301,597 S 6/1989 Lehtonen
4,844,453 A * 7/1989 Hestilow ..... 482/131
4,844,456 A 7/1989 Habing et al.
4,858,915 A 8/1989 Szabo
D303,558 S 9/1989 Alessandri
D306,052 S 2/1990 Brentham
4,911,438 A 3/1990 Van Straaten
4,915,377 A 4/1990 Mahnke et al.
4,917,379 A 4/1990 Maag
4,943,051 A 7/1990 Haskins et al.
4,944,641 A 7/1990 Alves
4,949,951 A 8/1990 Deola
4,949,958 A 8/1990 Richey
5,011,139 A 4/1991 Towley
5,050,873 A 9/1991 Jones
5,066,003 A 11/1991 Jones
5,066,004 A 11/1991 Jones
5,100,128 A 3/1992 Mabry
5,106,081 A 4/1992 Webb
5,108,095 A 4/1992 Nichols
5,217,422 A 6/1993 Domzalski
5,221,245 A 6/1993 Yeh
5,236,406 A 8/1993 Webber
5,250,013 A 10/1993 Brangi
5,254,067 A 10/1993 Habing et al.
5,263,914 A 11/1993 Simonson et al.
5,267,930 A 12/1993 Henes
5,277,681 A * 1/1994 Holt ..... 482/112
5,299,997 A 4/1994 Chen
5,304,107 A 4/1994 Jones
5,322,489 A 6/1994 Webb et al.
5,330,404 A 7/1994 Lopeteguy et al.
5,330,405 A 7/1994 Habing et al.
5,334,120 A 8/1994 Rasmussen
5,342,269 A 8/1994 Huang et al.
5,342,270 A 8/1994 Jones
5,346,447 A 9/1994 Stearns
5,352,171 A 10/1994 Lin
5,354,248 A 10/1994 Rawls et al.
5,356,357 A 10/1994 Wang et al.
5,356,358 A 10/1994 Chen
5,366,432 A 11/1994 Habing et al.
5,387,171 A 2/1995 Casey et al.
5,401,227 A 3/1995 Webber
D357,041 S 4/1995 McBride et al.
5,409,440 A 4/1995 Yang
5,417,633 A 5/1995 Habing
5,417,634 A 5/1995 Habing
5,419,751 A 5/1995 Byrd et al.
5,421,796 A 6/1995 Jones et al.
5,435,801 A * 7/1995 Hung ..... 482/130
5,437,589 A 8/1995 Habing
5,447,480 A 9/1995 Fulks
5,453,066 A 9/1995 Richter, Jr.
5,458,553 A 10/1995 Wu
5,478,298 A 12/1995 Chen
5,484,365 A 1/1996 Jones et al.
5,486,150 A 1/1996 Randolph
5,498,222 A 3/1996 Hur
5,499,959 A 3/1996 Holmes et al.
5,503,608 A 4/1996 Chang
5,505,679 A 4/1996 McBride et al.
5,507,710 A 4/1996 Chen
5,518,477 A 5/1996 Simonson
5,518,482 A * 5/1996 Hsieh ..... 482/130
5,520,599 A 5/1996 Chen
5,527,243 A 6/1996 Chen
5,527,249 A 6/1996 Harris
5,527,250 A 6/1996 Chen
5,529,561 A * 6/1996 Wang et al. ..... 482/136
5,533,953 A 7/1996 Lui et al.
5,540,639 A 7/1996 Potts et al.
D372,509 S 8/1996 Yang
5,547,443 A 8/1996 Chen
5,547,444 A 8/1996 Huang et al.
5,549,530 A 8/1996 Fulks
5,549,533 A 8/1996 Olson et al.
5,554,086 A 9/1996 Habing et al.
5,562,577 A 10/1996 Nichols et al.
5,562,578 A * 10/1996 Guillemette ..... 482/100
5,573,482 A 11/1996 Wang et al.
5,575,743 A * 11/1996 Jones et al. ..... 482/97
5,575,744 A * 11/1996 Jones et al. ..... 482/97
5,580,340 A 12/1996 Yu
5,580,341 A 12/1996 Simonson
5,582,563 A 12/1996 Fan
5,597,375 A 1/1997 Simonson
5,603,678 A 2/1997 Wilson
5,616,105 A 4/1997 Wang
5,616,107 A 4/1997 Simonson
5,616,110 A * 4/1997 Nascimento ..... 482/131
5,620,402 A 4/1997 Simonson
5,626,542 A 5/1997 Dalebout et al.
5,628,715 A 5/1997 Simonson
5,643,147 A 7/1997 Huang
5,643,152 A 7/1997 Simonson
5,658,227 A 8/1997 Stearns
D383,814 S 9/1997 Ward
D384,118 S 9/1997 Deblauw
5,669,865 A 9/1997 Gordon
5,672,142 A 9/1997 Wu
5,674,161 A 10/1997 Lin
5,676,626 A 10/1997 Huang
5,681,247 A 10/1997 Webber
5,683,334 A 11/1997 Webber
5,690,593 A 11/1997 Huang
5,695,434 A 12/1997 Dalebout et al.
5,695,435 A 12/1997 Dalebout et al.
5,702,328 A 12/1997 Mansvelt
5,711,749 A 1/1998 Miller
5,720,695 A 2/1998 Eckmann
5,722,918 A 3/1998 Lee
5,733,229 A 3/1998 Dalebout et al.
5,733,232 A 3/1998 Hsu
5,749,813 A 5/1998 Domzalski
5,800,321 A 9/1998 Webber
5,803,882 A 9/1998 Habing et al.
5,810,698 A 9/1998 Hullett et al.
5,810,701 A 9/1998 Ellis et al.
5,827,158 A 10/1998 Drecksel
5,833,585 A * 11/1998 Jones et al. ..... 482/97
5,876,095 A 3/1999 Johnston
5,885,193 A 3/1999 Habing et al.
5,897,467 A 4/1999 Habing et al.
5,897,473 A 4/1999 Koenig
5,899,836 A 5/1999 Chen
5,904,641 A * 5/1999 Huang ..... 482/131
5,906,564 A 5/1999 Jacobsen
5,916,072 A 6/1999 Webber
5,938,570 A 8/1999 Maresh
5,938,571 A 8/1999 Stevens
5,944,641 A 8/1999 Habing
5,961,427 A 10/1999 Habing et al.

(56) References Cited

U.S. PATENT DOCUMENTS

| | | | | |
|---|---|---|---|---|
| 5,961,428 | A | 10/1999 | Webber | |
| 5,967,954 | A | 10/1999 | Habing | |
| 5,971,895 | A | 10/1999 | Habing | |
| 5,971,901 | A | 10/1999 | Shaw | |
| 5,989,165 | A | 11/1999 | Giannelli et al. | |
| 5,997,446 | A | 12/1999 | Stearns | |
| 5,997,447 | A | 12/1999 | Giannelli et al. | |
| 6,004,247 | A | 12/1999 | Webber | |
| 6,015,372 | A * | 1/2000 | Steffee et al. | 482/137 |
| 6,024,677 | A | 2/2000 | Siwertz | |
| 6,030,322 | A | 2/2000 | Webber | |
| 6,056,675 | A | 5/2000 | Aruin et al. | |
| 6,056,678 | A | 5/2000 | Giannelli | |
| 6,071,216 | A | 6/2000 | Giannelli et al. | |
| 6,074,328 | A | 6/2000 | Johnson | |
| 6,080,091 | A | 6/2000 | Habing et al. | |
| 6,086,521 | A | 7/2000 | Solland | |
| 6,090,020 | A | 7/2000 | Webber | |
| 6,090,022 | A * | 7/2000 | Colecchi | 482/131 |
| 6,117,055 | A * | 9/2000 | Boland | 482/121 |
| 6,120,419 | A | 9/2000 | Huang | |
| 6,135,930 | A | 10/2000 | Kuo | |
| 6,142,914 | A | 11/2000 | Crawford et al. | |
| 6,142,917 | A | 11/2000 | Giannelli et al. | |
| 6,152,864 | A | 11/2000 | Giannelli et al. | |
| 6,162,153 | A | 12/2000 | Perez et al. | |
| 6,220,993 | B1 | 4/2001 | Sencil | |
| 6,244,995 | B1 | 6/2001 | Prsala | |
| 6,244,996 | B1 | 6/2001 | Sencil | |
| 6,251,047 | B1 | 6/2001 | Stearns et al. | |
| 6,254,516 | B1 | 7/2001 | Giannelli et al. | |
| 6,264,588 | B1 | 7/2001 | Ellis | |
| 6,287,241 | B1 | 9/2001 | Ellis | |
| 6,302,832 | B1 | 10/2001 | Stearns | |
| 6,302,833 | B1 | 10/2001 | Ellis et al. | |
| 6,312,366 | B1 | 11/2001 | Prusick | |
| 6,319,178 | B1 | 11/2001 | Webber | |
| 6,340,342 | B1 | 1/2002 | Lee | |
| 6,350,219 | B1 | 2/2002 | Hobson | |
| 6,387,020 | B1 | 5/2002 | Simonson | |
| 6,394,937 | B1 | 5/2002 | Voris | |
| 6,491,609 | B2 | 12/2002 | Webber | |
| 6,517,468 | B1 | 2/2003 | Lepcevic | |
| 6,561,960 | B2 | 5/2003 | Webber | |
| 6,579,213 | B1 | 6/2003 | Webber et al. | |
| 6,605,022 | B2 | 8/2003 | Webber | |
| 6,605,024 | B2 | 8/2003 | Stearns | |
| D481,428 | S | 10/2003 | Giannelli et al. | |
| 6,659,919 | B2 | 12/2003 | Deola | |
| 6,676,577 | B2 | 1/2004 | Stearns | |
| 6,733,426 | B2 * | 5/2004 | Bussell | 482/112 |
| 6,743,158 | B2 | 6/2004 | Giannelli et al. | |
| 6,752,748 | B1 | 6/2004 | Scotti | |
| 6,770,017 | B1 | 8/2004 | Leipheimer | |
| 6,811,522 | B1 | 11/2004 | McQuinn | |
| 6,855,098 | B2 | 2/2005 | Reitz et al. | |
| 6,913,565 | B2 | 7/2005 | Mitchell et al. | |
| 6,916,278 | B2 | 7/2005 | Webber | |
| 6,926,647 | B1 * | 8/2005 | Huang et al. | 482/72 |
| 6,966,872 | B2 | 11/2005 | Eschenbach | |
| 6,971,978 | B2 | 12/2005 | Hyder | |
| 6,988,977 | B2 | 1/2006 | Webber et al. | |
| D516,139 | S * | 2/2006 | Panatta | D21/676 |
| 7,052,444 | B2 | 5/2006 | Webber | |
| 7,052,446 | B2 | 5/2006 | Morris et al. | |
| 7,070,545 | B2 | 7/2006 | Lull et al. | |
| 7,108,641 | B2 | 9/2006 | Pertegaz-Esteban | |
| 7,128,694 | B1 * | 10/2006 | Fulks | 482/94 |
| 7,141,003 | B2 | 11/2006 | Wu | |
| 7,141,008 | B2 | 11/2006 | Krull et al. | |
| 7,166,066 | B2 | 1/2007 | Webber | |
| 7,220,221 | B2 * | 5/2007 | Mosimann et al. | 482/100 |
| 7,223,213 | B2 | 5/2007 | Golesh | |
| 7,229,389 | B2 | 6/2007 | Hong | |
| 7,322,906 | B2 | 1/2008 | Webber | |
| 7,331,911 | B2 | 2/2008 | Webber et al. | |
| 7,335,140 | B2 | 2/2008 | Webber et al. | |
| 7,340,786 | B1 * | 3/2008 | Smith | 5/648 |
| 7,357,761 | B2 | 4/2008 | Mattox | |
| 7,357,768 | B2 | 4/2008 | Marshall | |
| 7,361,125 | B2 | 4/2008 | Webber et al. | |
| 7,384,381 | B2 | 6/2008 | Webber et al. | |
| 7,396,319 | B1 * | 7/2008 | Ellis | 482/100 |
| 7,468,024 | B2 | 12/2008 | Webber et al. | |
| 7,485,078 | B1 * | 2/2009 | Chen | 482/130 |
| 7,549,949 | B2 | 6/2009 | Webber et al. | |
| 7,553,263 | B2 | 6/2009 | Webb et al. | |
| 7,563,209 | B2 | 7/2009 | Webber et al. | |
| 7,594,880 | B2 | 9/2009 | Webber et al. | |
| 7,601,187 | B2 | 10/2009 | Webber et al. | |
| 7,654,938 | B2 | 2/2010 | Webber et al. | |
| 7,654,940 | B2 | 2/2010 | Webber et al. | |
| 7,670,269 | B2 | 3/2010 | Webber et al. | |
| 7,678,022 | B1 * | 3/2010 | Hsieh | 482/5 |
| 7,717,832 | B2 | 5/2010 | Webber et al. | |
| 7,731,638 | B2 | 6/2010 | Webber et al. | |
| 7,766,802 | B2 | 8/2010 | Webber et al. | |
| 7,794,371 | B2 | 9/2010 | Webber et al. | |
| 7,794,372 | B1 | 9/2010 | Webber et al. | |
| 7,878,953 | B2 | 2/2011 | Webber et al. | |
| 7,938,760 | B1 | 5/2011 | Webber et al. | |
| 7,981,010 | B1 | 7/2011 | Webber et al. | |
| 7,993,251 | B1 | 8/2011 | Webber et al. | |
| 2002/0013199 | A1 | 1/2002 | Giannelli et al. | |
| 2002/0103058 | A1 | 8/2002 | Webber | |
| 2002/0183173 | A1 | 12/2002 | Abelbeck et al. | |
| 2002/0187879 | A1 | 12/2002 | Ball et al. | |
| 2003/0199362 | A1 | 10/2003 | Chamberlin | |
| 2004/0005966 | A1 | 1/2004 | Chen | |
| 2005/0032611 | A1 | 2/2005 | Webber et al. | |
| 2005/0096196 | A1 | 5/2005 | Webber et al. | |
| 2005/0096197 | A1 | 5/2005 | Webber et al. | |
| 2005/0096198 | A1 | 5/2005 | Webber et al. | |
| 2006/0116253 | A1 | 6/2006 | Nizam | |
| 2006/0148625 | A1 | 7/2006 | Garner | |
| 2006/0211549 | A1 | 9/2006 | Nohejl | |
| 2006/0247107 | A1 | 11/2006 | Carter | |
| 2006/0276313 | A1 | 12/2006 | Hong | |
| 2007/0037673 | A1 | 2/2007 | Giannelli et al. | |
| 2007/0232462 | A1 | 10/2007 | Webber et al. | |
| 2007/0232467 | A1 | 10/2007 | Puzey | |
| 2007/0270290 | A1 * | 11/2007 | Mosimann et al. | 482/100 |
| 2007/0293377 | A1 | 12/2007 | Webber et al. | |
| 2007/0293378 | A1 | 12/2007 | Webber et al. | |
| 2008/0058176 | A1 * | 3/2008 | Webber et al. | 482/94 |
| 2008/0058181 | A1 | 3/2008 | Webber et al. | |
| 2008/0132389 | A1 | 6/2008 | Webber et al. | |
| 2008/0153677 | A1 | 6/2008 | Webber | |
| 2008/0182732 | A1 | 7/2008 | Webber et al. | |
| 2008/0214365 | A1 | 9/2008 | Webber et al. | |
| 2008/0214367 | A1 | 9/2008 | Webber et al. | |
| 2008/0220950 | A1 | 9/2008 | Webber et al. | |
| 2008/0234110 | A1 | 9/2008 | Webber et al. | |
| 2008/0242517 | A1 | 10/2008 | Webber et al. | |
| 2008/0248929 | A1 | 10/2008 | Webber et al. | |
| 2010/0323853 | A1 * | 12/2010 | Webber et al. | 482/96 |

OTHER PUBLICATIONS

Paramount AP-3800 and 3900 Hip and Abduction Adductor, 2001, 2 pages.

Tuff Stuff KDX-1 Gym, date unknown, is admitted prior art for this application, 1 page.

Hoist S-413, Innter/Outer Thigh, 1995, 1 page.

Gym-80 Machine, 2001, 1 page.

Flex FL-106 Adductor and FL-105 Abductor, date unknown is admitted prior art for this application, 1 page.

Flex Fitness, FL-105 Abductor, 2002, 1 page.

Body Masters brochure, 2002, 1 page.

CD 2400 Leg Extension/Leg Curl, Hoist Fitness Systems, Owner's Catalog, 2005, 1 page.

Flex Fitness Brochure, (date unknown), is admitted prior art for this application, 1 page.

(56) References Cited

OTHER PUBLICATIONS

Flex Product Sheet, (date unknown), is admitted prior art for this application, 1 page.

Hoist brochure, 1993 Hoist HLP brochure, 1998, 1 page.

Models 217 and 206-2, Polaris Brochure, (date unknown), is admitted prior art for this application, 1 page.

* cited by examiner

THIGH EXERCISE MACHINE WITH ROCKING USER SUPPORT

RELATED APPLICATION

The present application claims the benefit of U.S. provisional patent application No. 61/310,884 filed Mar. 5, 2010, which is incorporated herein by reference in its entirety.

BACKGROUND

1. Field of the Invention

This invention relates generally to exercise machines, and is particularly concerned with a thigh exercise machine.

2. Related Art

In an inner thigh or adductor muscle exercise, a leg is moved inward from an outwardly spread position into an inner position. In an outer thigh or abductor muscle exercise, the movement is reversed, with a leg rotated outward from an inward position. Thigh exercise machines allow exercising of both thighs while seated on a user support, and include movement arms rotatable about vertical axes between a first position extending forward from a user support seat and a second position extending laterally from the seat. A pad on the inside of each movement arm is engaged by the user's outer thighs while rotating both arms outward to perform an abductor exercise. A pad on the outside of each movement arm is engaged by the user's inner thighs while rotating the arms inward from the outward position to perform an adductor exercise.

In current thigh exercise machines, the user support is stationary during the exercise, although it may have an adjustable back rest which is adjusted prior to an exercise to position the exerciser for an abductor or adductor exercise. Since the user is in a fixed position on the user support during the thigh exercise, their hips are unable to flex and tilt naturally as they rotate their legs inward or outward, which may result in stress to the muscles of the low back and groin.

SUMMARY

A thigh exercise machine in one embodiment has a pivotally mounted user support seat, a pair of exercise arms mounted for rotation between inner and outer positions, each arm having a thigh pad positioned to engage a user's inner or outer thigh, and a connecting linkage which translates movement of the exercise arms into rocking movement of the user support. In one embodiment, the arrangement is such that the user is positioned in an upright posture when their legs are together and a reclined posture when their legs are spread apart. This positioning is designed to allow the hips to flex and tilt naturally, reducing stress to the muscles in the low back and groin.

In one embodiment, the machine is an inner thigh or adductor exercise machine, with user engaging pads on the outside of the exercise arms for engagement by the user's inner thighs while pushing the arms inwards. In a second embodiment, the machine is an outer thigh or abductor exercise machine with user engaging pads on the inside of the exercise arms for engagement by the user's outer thighs as they push the arms outward. In a third embodiment, the machine is a combined inner thigh/outer thigh exercise machine, with user engaging pads that are swivel mounted for movement between inner thigh and outer thigh exercise positions.

The combined movement of the user support and exercise arms provides a more comfortable and natural feeling exercise motion that constantly adjusts the position of the user during the exercise to reduce stress on muscles in the low back and groin. The rocking motion of the user support during the exercise also makes the exercise more enjoyable for the exerciser.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
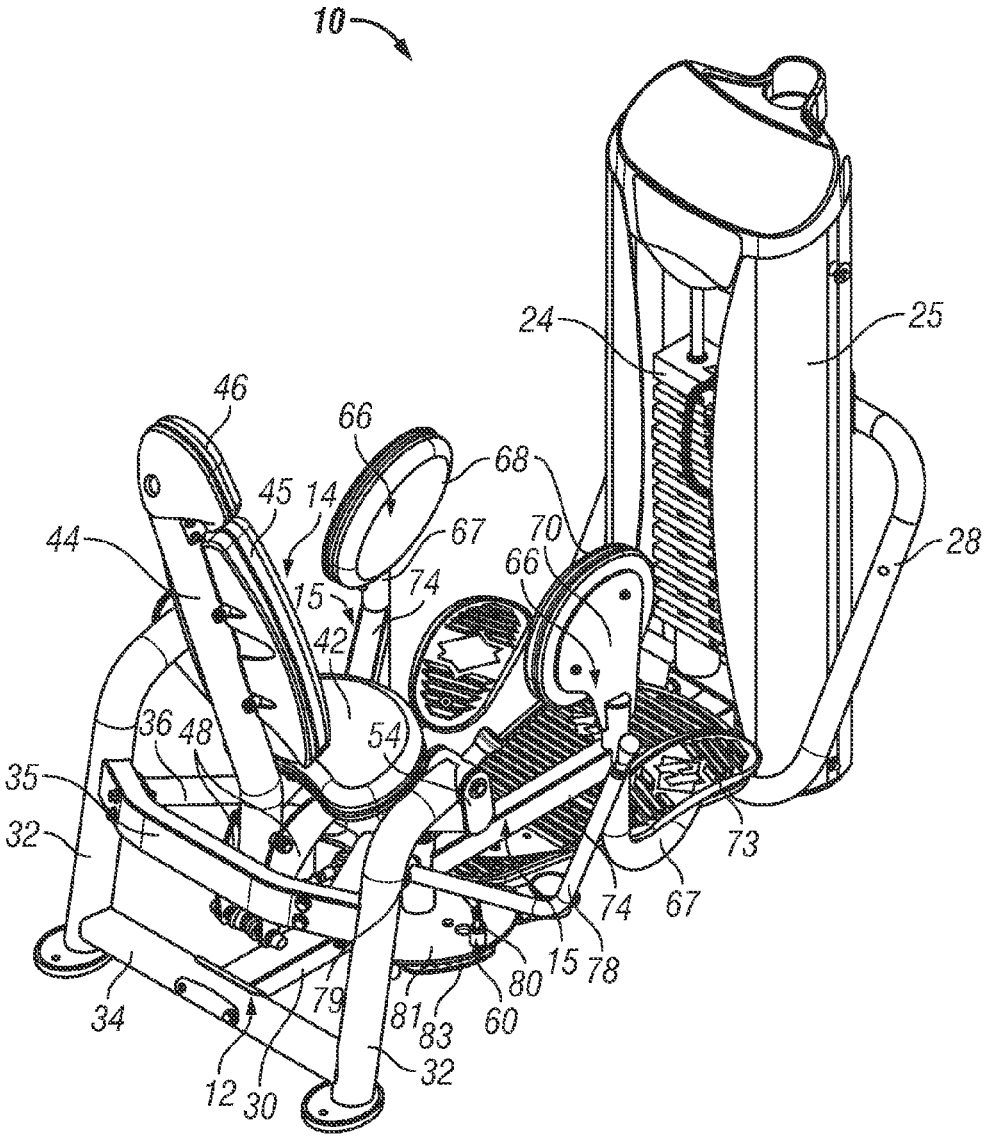
FIG. 1 is a rear perspective view of an outer thigh exercise machine according to a first embodiment, with the machine in a start position for an outer thigh exercise.

Certain embodiments as disclosed herein provide for a thigh exercise machine with a rocking user support. Both the user support and the exercise arms move during an exercise, with a connecting linkage translating movement of the exercise arms to rocking movement of the user support so that the position of the user relative to the thigh engaging pads is adjusted during the exercise.

After reading this description, it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 6 illustrate an outer thigh or abductor exercise machine 10 according to a first embodiment. The outer thigh exercise machine 10 has a stationary, floor engaging main frame 12, a user support 14 which is pivotally mounted on the main frame, left and right exercise arm assemblies 15 which are each pivotally mounted on the main frame via respective pivot mounts 18 for rotation about respective vertical pivot axes, and multiple link connecting linkages 20 (see FIGS. 2 and 3) which translate rotation of the respective exercise arms into pivoting movement of the user support.

Figure 2:
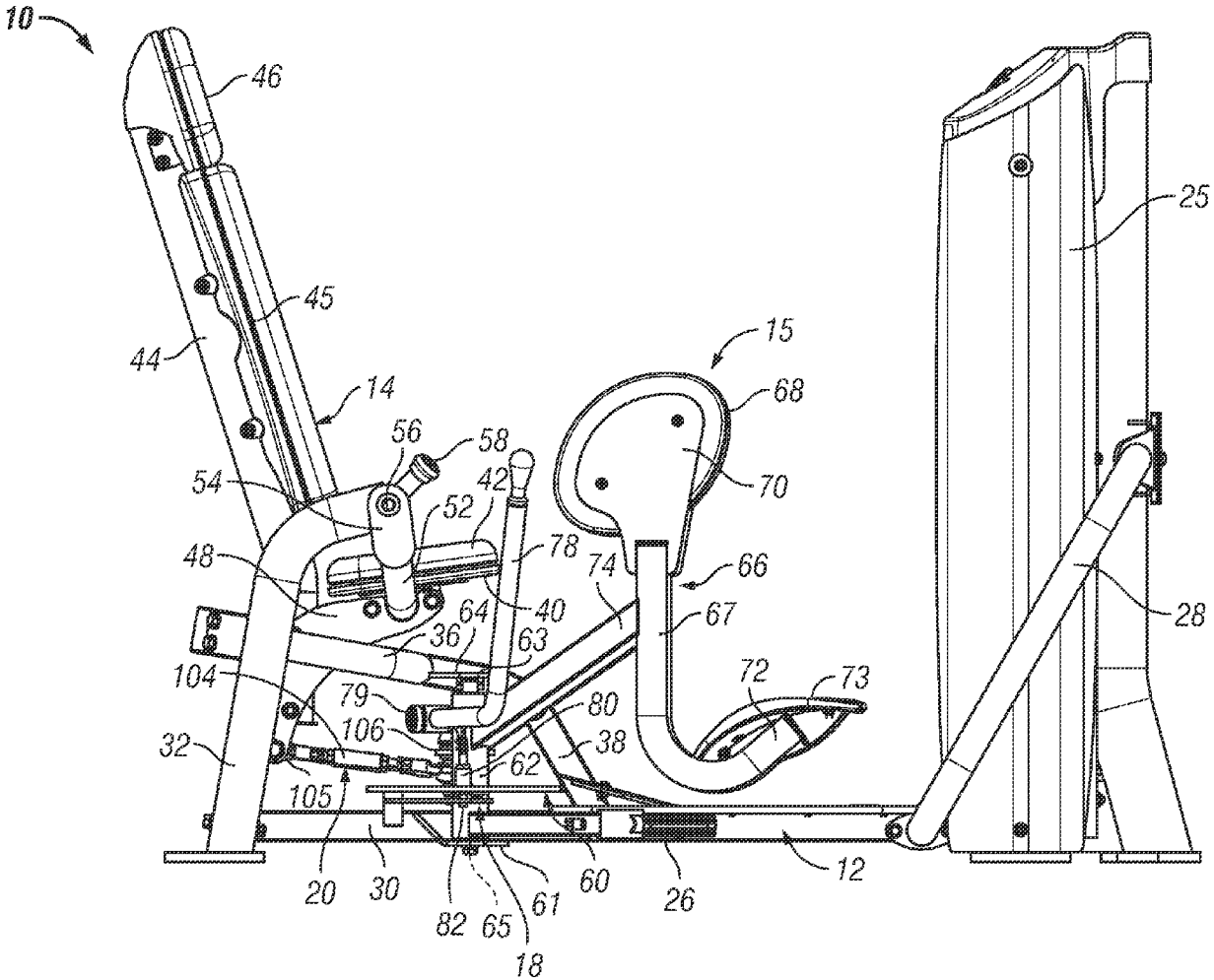
FIG. 2 is a side elevation view of the machine in the start position of FIG. 1.
Figure 3:
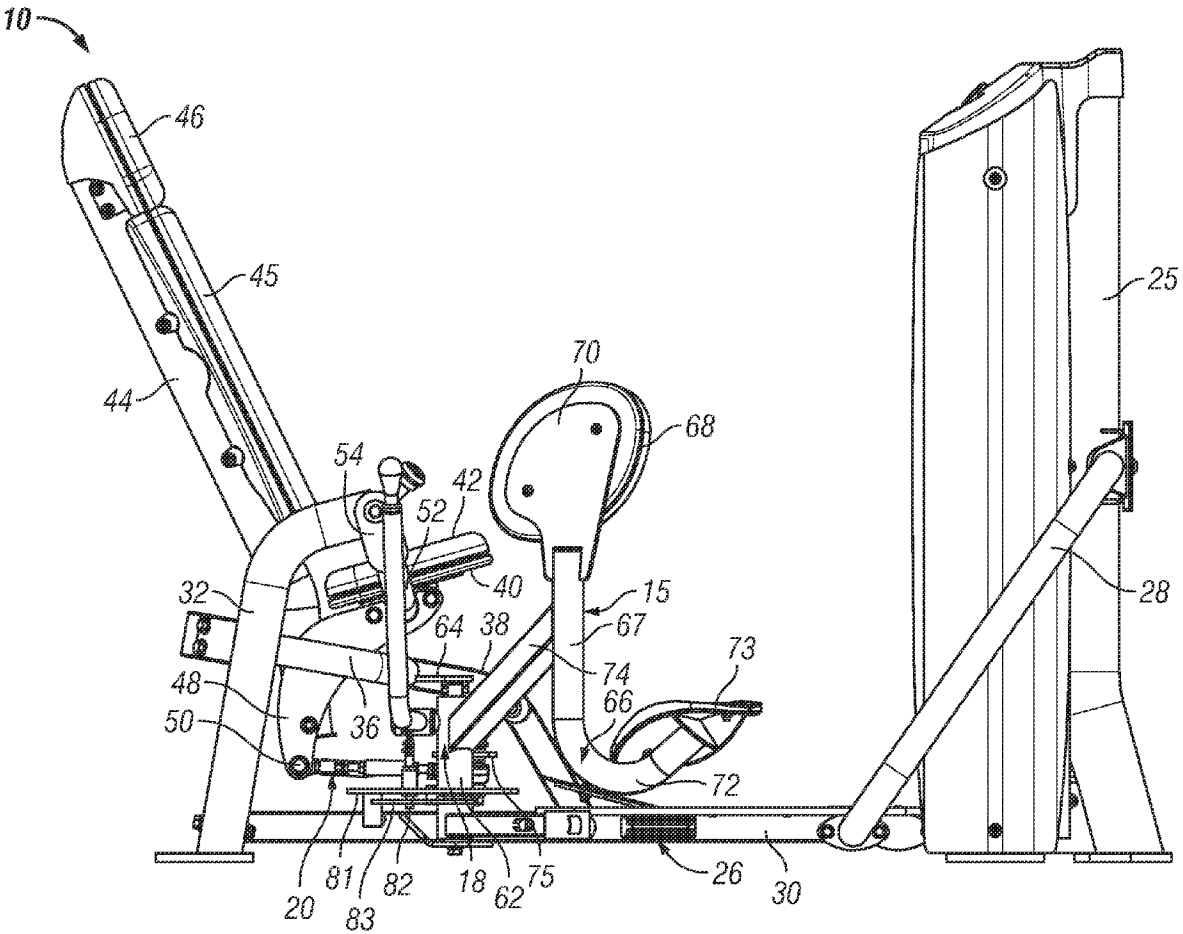
FIG. 3 is a side elevation view similar to FIG. 2 but showing an end position for the outer thigh exercise.
Figure 6:
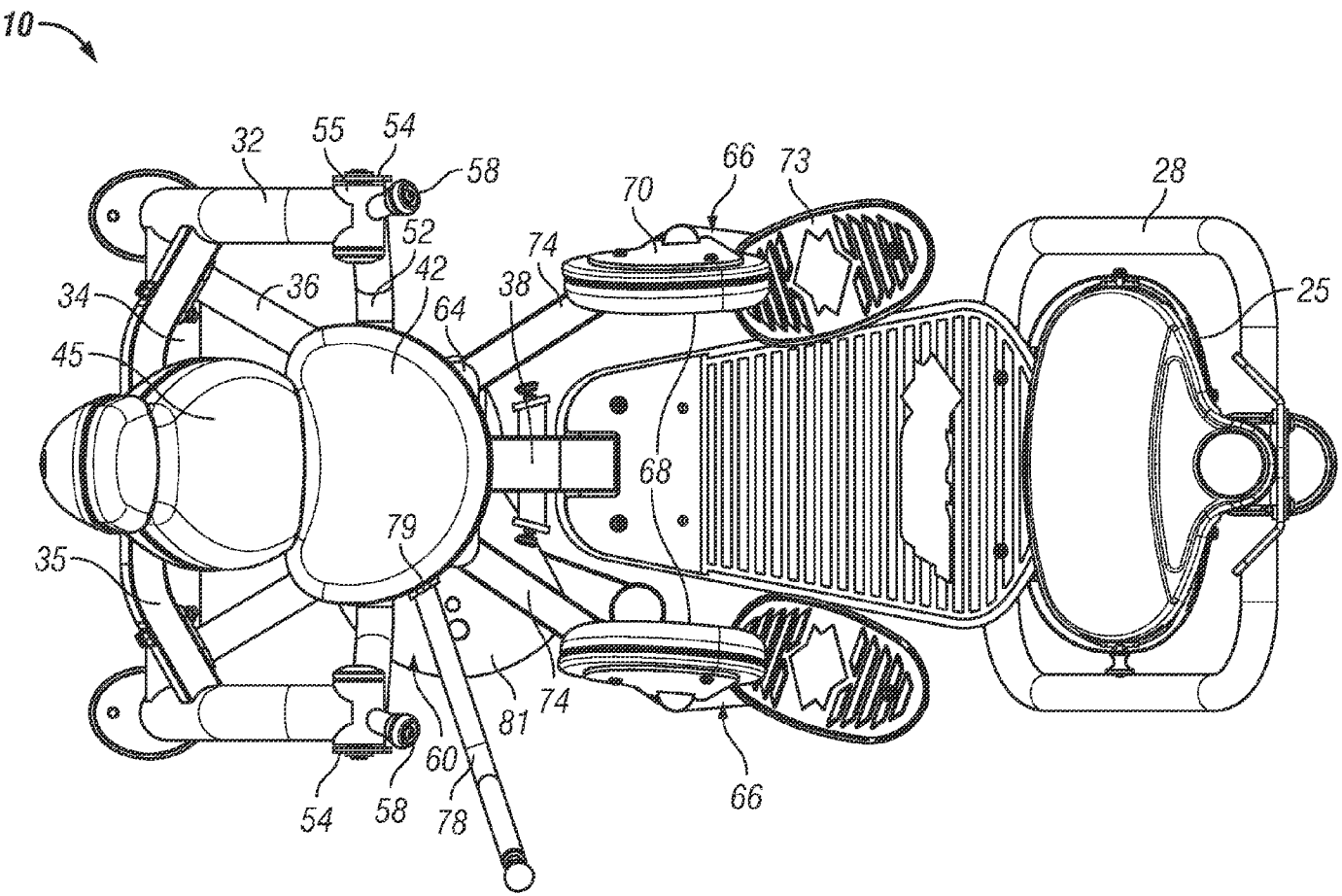
FIG. 6 is a top plan view of the machine of FIGS. 1 to 5.

The exercise arm assemblies are linked to selected weights in a weight stack 24 in housing 25 at the forward end of main frame 12 via a cable and pulley assembly 26 in a standard manner, so as to provide resistance to rotation of the exercise arm assemblies between the start and end positions of FIGS. 2 and 3. The weight stack or other exercise resistance may alternatively be linked to the user support. As best illustrated in FIGS. 2 and 6, weight stack housing 25 is secured to the main frame via support arms 28 which extend from opposite sides of main frame base strut 30 to the rear of the housing. The main frame has a rear upright portion having a pair of uprights 32, and a base member 34 and cross member 35 extending between the uprights, as best illustrated in FIG. 1. A support member or yoke 36 extends forwards from cross member 35 and is secured to the base strut 30 via connecting strut 38 at a location spaced forward from the user support.

The user support 14 has a seat pad support plate 40 on which seat pad 42 is mounted and an upright or back rest support rod 44 on which back pad 45 and head rest 46 are mounted. Parallel pivot brackets or plates 48 extend downward and rearward from seat support plate 40 and are secured to opposite sides of a downward extension of the back rest support rod 44 below the seat. The lower ends of the plates 48 and rod 44 are pivoted to rear ends of the respective connecting linkages 20 for rotation about pivot axis 50 (see FIG. 3). A seat support strut 52 extends under seat pad 42 and outwardly and upwardly on each side of the seat from each pivot bracket or plate 48. Pivot plates 54 are mounted at the outer ends of strut 52. A pivot pin extends inward from each pivot plate 54 for rotatable engagement in a pivot sleeve 55 at the forward end of each rear upright strut of the main frame, defining user support pivot axis 56. Stabilizing handles 58 are mounted on the respective pivot sleeves 55 for gripping by a user during an exercise.

The two exercise arm assemblies 15 are identical and like reference numbers are used for like parts as appropriate. A range of motion (ROM) adjustment system 60 to adjust the starting position (pre-stretch) of the exercise arm assemblies is associated with one of the arms, as described in more detail below. Each pivot mount 18 of the exercise arm assemblies comprises a vertical pivot sleeve 62 rotatably mounted on a respective pivot pin 63 extending between a horizontal plate or mount 64 extending from a respective side of main frame support strut 38 and a base plate 61 secured to base strut 30, as best illustrated in FIGS. 2 and 3, defining a vertical pivot axis 65 for the respective exercise arm assembly. Each arm assembly comprises an exercise arm 66 which has an upright portion 67 with a user engaging pad 68 at its upper end secured to the inner face of a pad mount 70, and a lower end portion 72 which is bent upwardly and away from the lower end of an upright portion of the arm. A foot rest 73 is secured to the end of each arm portion 72. Arm 66 is connected to pivot sleeve 62 by connecting strut 74.

As illustrated in more detail in FIGS. 11 and 12, and described below in connection with the second embodiment, each connecting linkage 20 comprises a control link 104 pivotally tied to the user support at its rear end via a ball joint 105 and pivotally tied to a respective exercise assembly at its forward end via ball joint 106. Ball joints 105 are each tied to the rear ends of the respective user support pivot brackets 48. Ball joints 106 are each linked to a respective pivot sleeve 62 as described in more detail below in connection with FIGS. 11 and 12. The connection is such that that rotation of sleeve 66 from the position in FIG. 2 to the position in FIG. 3 simultaneously pulls the connecting linkage 20 forwards, as discussed below.

The range of motion (ROM) adjustment system 60 comprises an adjustment lever 78 pivotally mounted on one of the exercise arm pivot sleeves 62 (in this case the pivot sleeve for the right hand exercise arm) at pivot 79 and linked to a pull pin assembly 80 that is mounted on a first plate 81 which is associated with one of the exercise arms. The pull pin assembly has a plunger 82 which extends through a hole in first plate 81 and engages in one of a series of holes located in a second plate 83 associated with a movement arm that is linked via cable and pulley assembly 26 with the weight stack. The movement arm may be a cam, pulley, lever or the like. Pulling up on adjustment lever 78 releases the pull pin plunger from plate 83 and allows the exercise arms 66 to be rotated outward or inward relative to plate 83 to change the exercise start position and increase or decrease the stretch on the outer thigh muscles. The arms are dependent because they are both tied to the user support by the connecting linkages 20, as described in more detail below for the inner thigh machine in connection with FIGS. 11 and 12, which also illustrate the ROM plates 81 and 83 in more detail.

In order to use the outer thigh exercise machine 10, the user sits on the seat with the user support frame in the start position of FIGS. 1 and 2, grips the stabilizer handles 58, then engages thigh pads 68 with their outer thighs, with their feet engaging foot plates 73. If needed, they can adjust the starting position (pre-stretch) of the exercise arm assembly by using the ROM adjustment system 60 described above. The user then starts the exercise by rotating their legs outward, simultaneously rotating the exercise arms 66 outward about their vertical pivot axes 65. This simultaneously pulls the connecting linkages 20 forwards and rotates the user support 14 rearwards about pivot axis 56 between the slightly reclined start position of FIG. 2 and the more reclined end position of FIG. 3.

Figure 4:
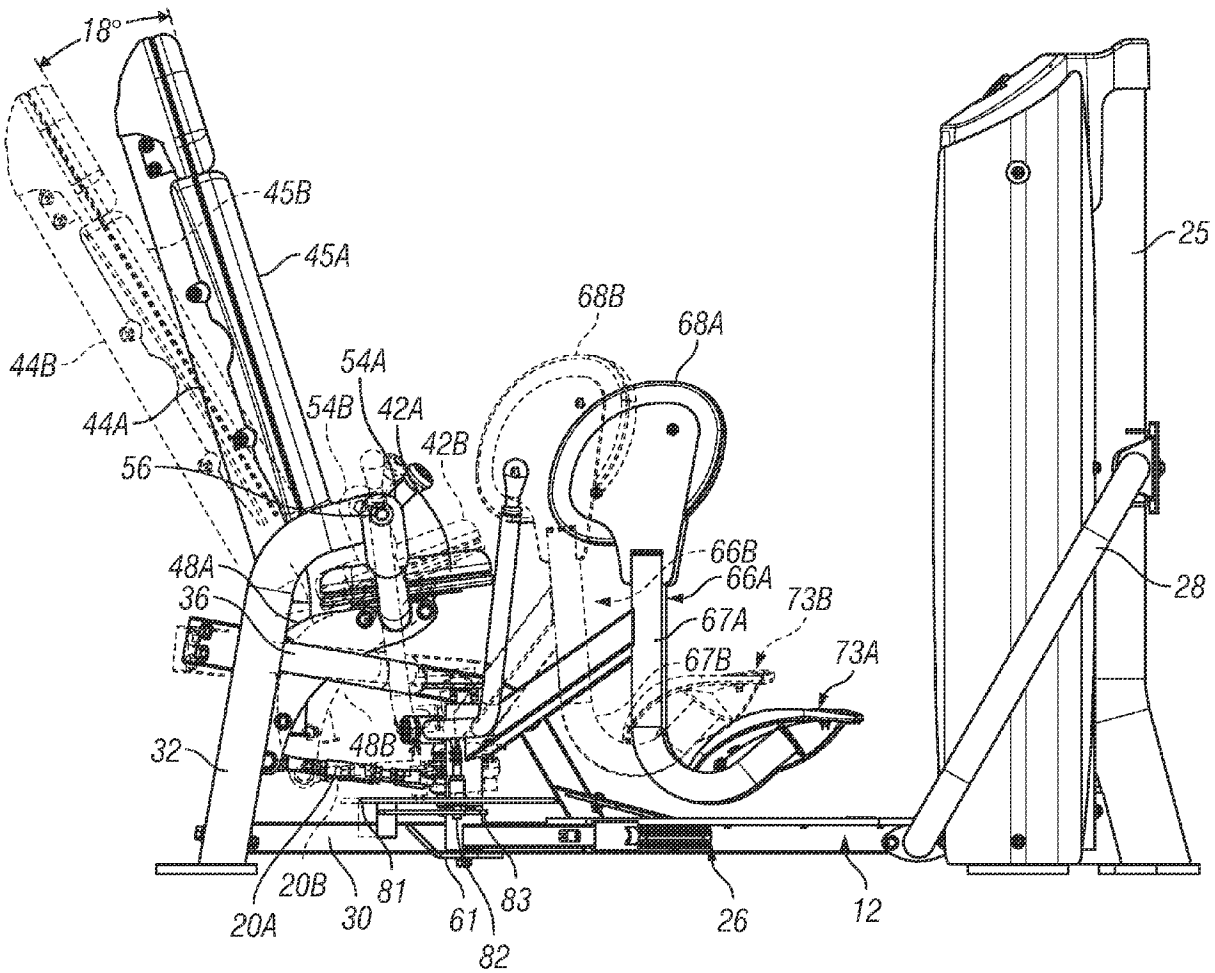
FIG. 4 is a side elevation view showing the two positions of FIGS. 2 and 3 superimposed, to illustrate movement of each moving part of the machine during an exercise.
Figure 5:
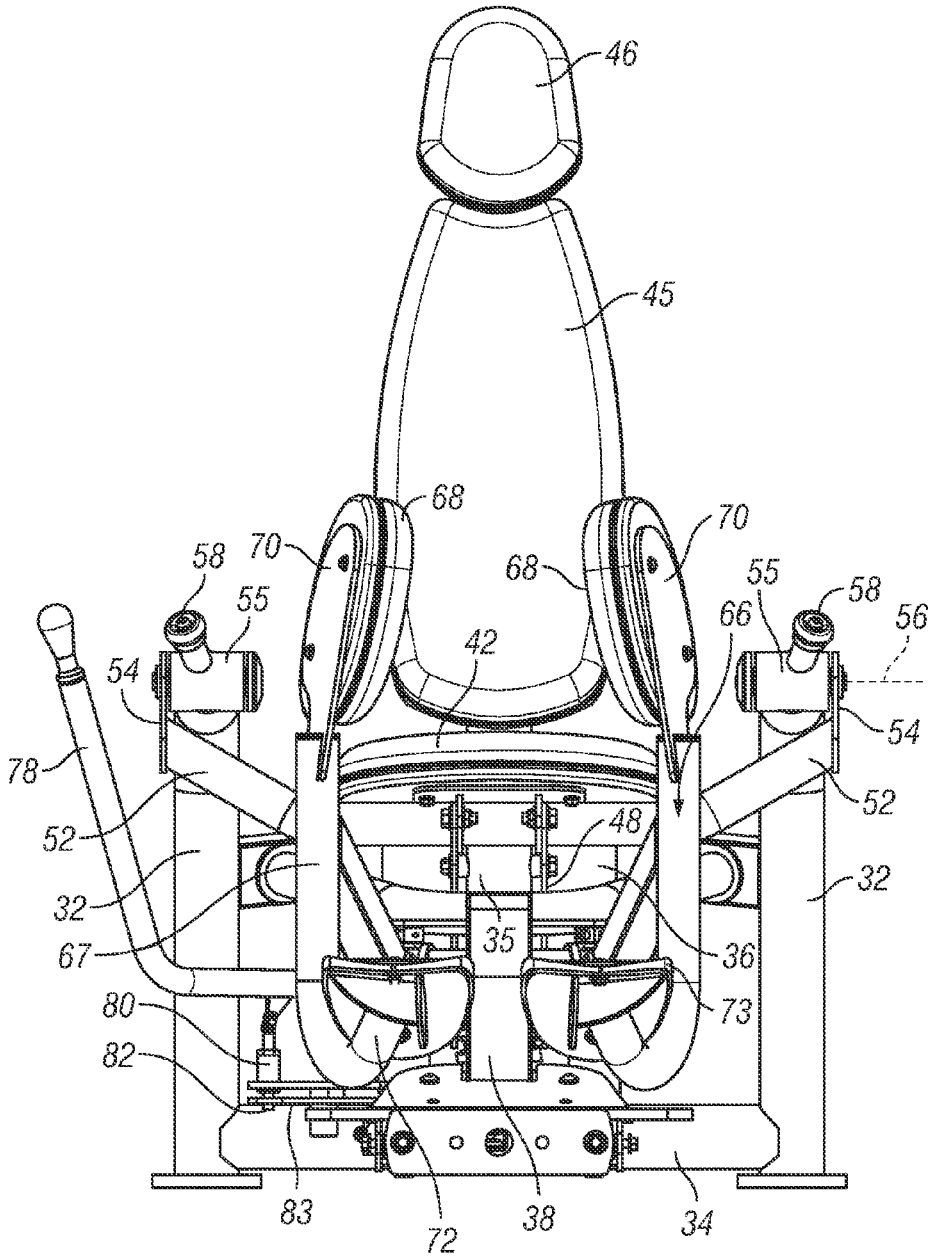
FIG. 5 is a front elevation view of the machine of FIGS. 1 to 4, without the weight stack.

In FIG. 4, the start and finish positions of the machine in FIGS. 2 and 3 are overlapped. Part numbers followed by the letter A correspond to the solid line, start position of the thigh exercise machine and part numbers followed by the letter B correspond to the dotted line, end position of the outer thigh exercise machine. As seen in FIG. 4, the exercise arms rotate between position 66A and 66B, pulling the connecting linkages 20 forwards from position 20A to 20B. This in turn pulls the lower end of the pivot brackets 48 on the user support forward and downward, rotating the brackets and the user support rearward in an anti-clockwise direction about pivot axis 56, so that the seat pad and back pad rotate between positions 42A and 42B, and positions 45A and 45B, respectively. As illustrated in FIG. 4, the back pad moves through an angle of around 16 degrees between the start position 45A and end position 45B of FIG. 4. The movement pattern between the exercise arms and the user support as controlled by the arrangement of the pivot axes and the connecting linkages 20 positions the user in a substantially upright posture when their legs are together and a reclined posture when their legs are spread apart. This positioning is designed to allow the hips to flex and tilt naturally during the exercise, reducing stress to the muscles in the low back and groin.

FIGS. 7 to 15 illustrate an inner thigh or adductor exercise machine 100 according to a second embodiment. Apart from the location of the thigh engaging pads and the connection of the exercise resistance to resist movement of the exercise arms, all parts of the machine 100 are identical to those of the previous embodiment, and like reference numbers are used for like parts as appropriate. In machine 100, thigh engaging pads 102 and mounting plates 107 at the top of leg portion 67 are reversed, so that the pads 102 face outward rather than inward as in the previous embodiment. The cable and pulley linkage to the exercise resistance is connected so that resistance is provided to movement of the exercise arm assembly from an outer to an inner position, instead of from an inner to an outer position as is the case with the outer thigh machine 10.

Figure 11:
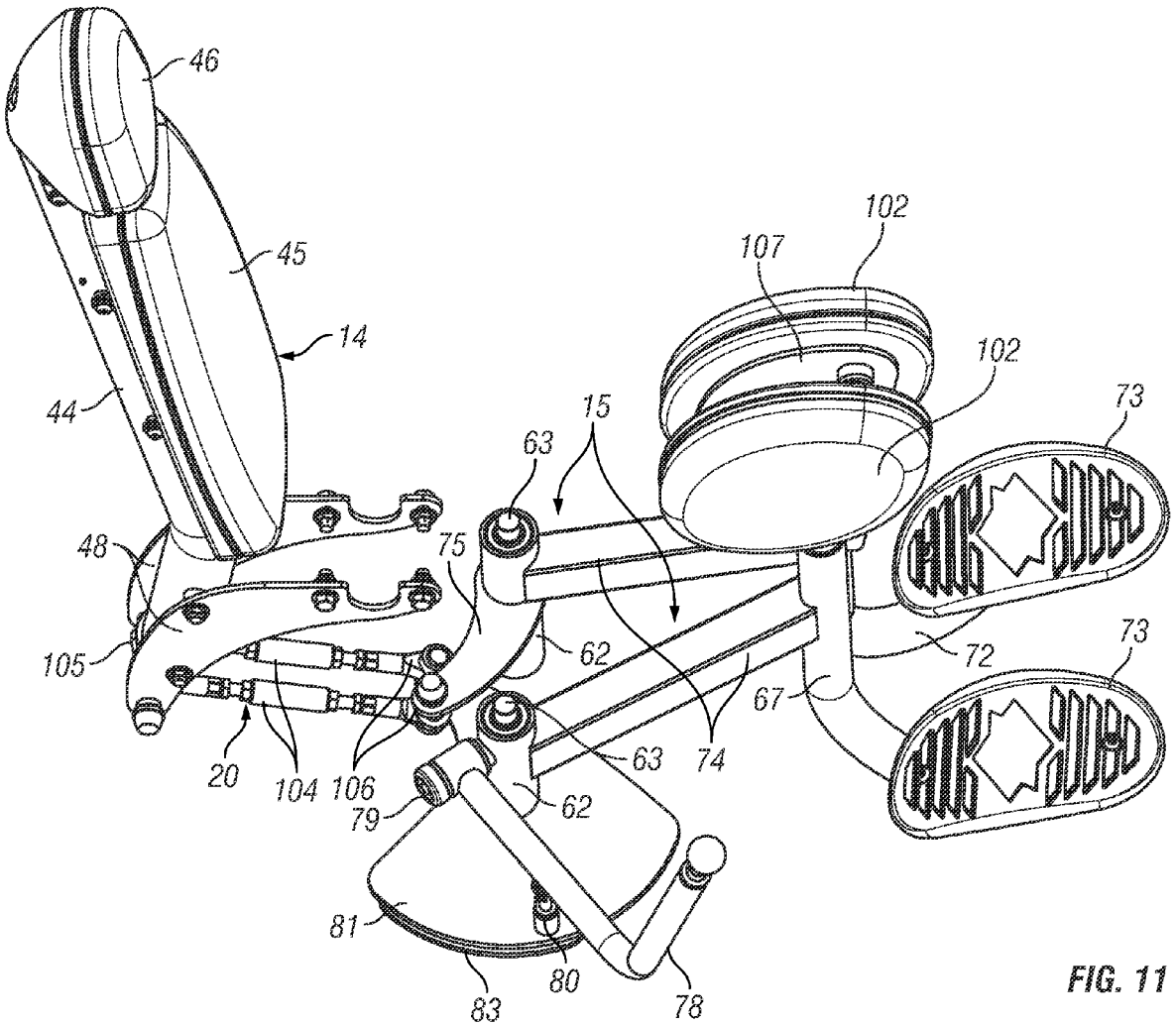
FIG. 11 is a perspective view of part of the user support, the connecting linkages, and exercise arm assemblies of the machine of FIGS. 7 to 10 in the end position for an inner thigh exercise, with all other parts of the machine removed to reveal the connecting linkage between the exercise arms and user support.
Figure 12:
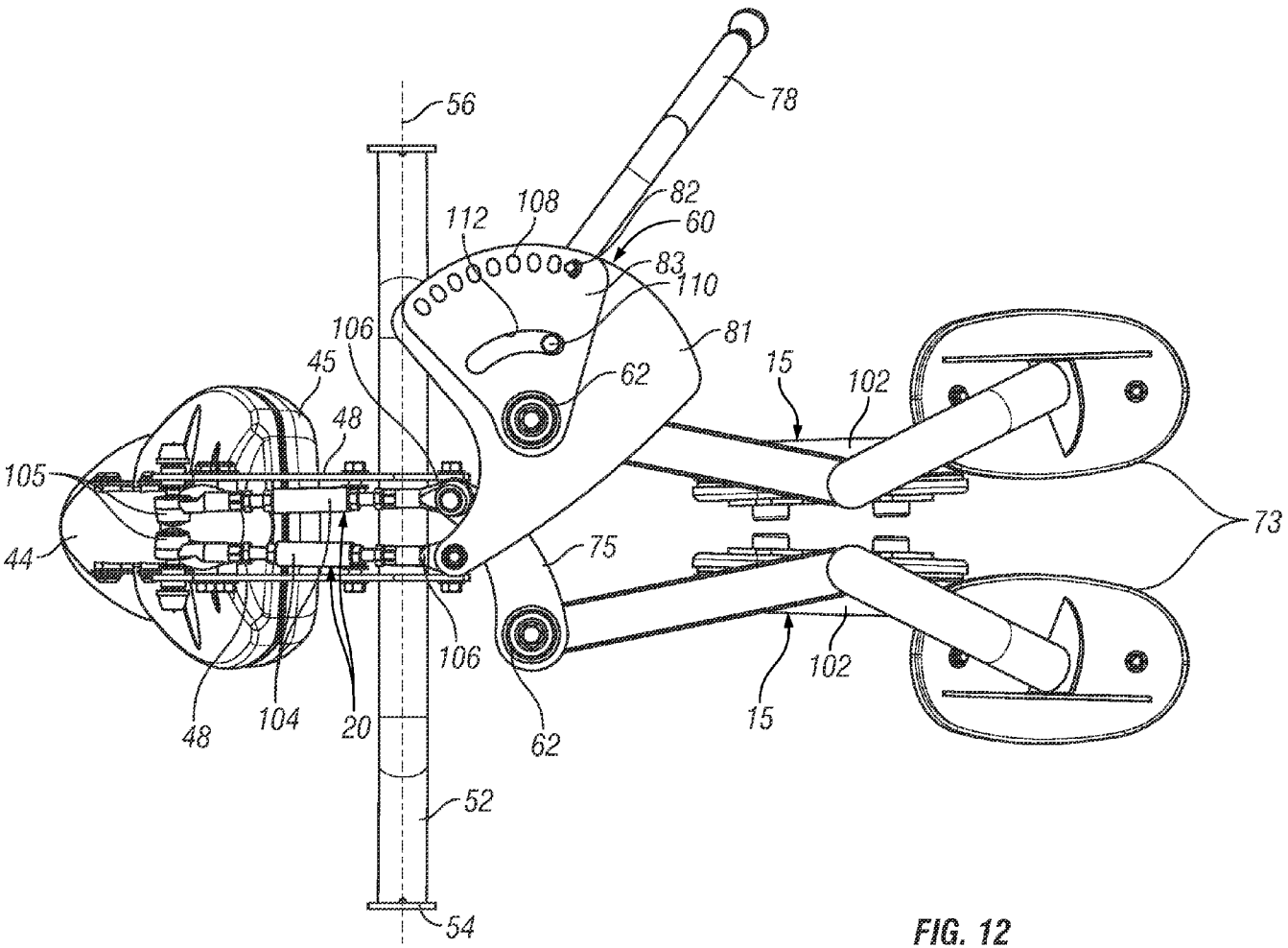
FIG. 12 is a bottom plan view of the parts in the position of FIG. 11
Figure 13:
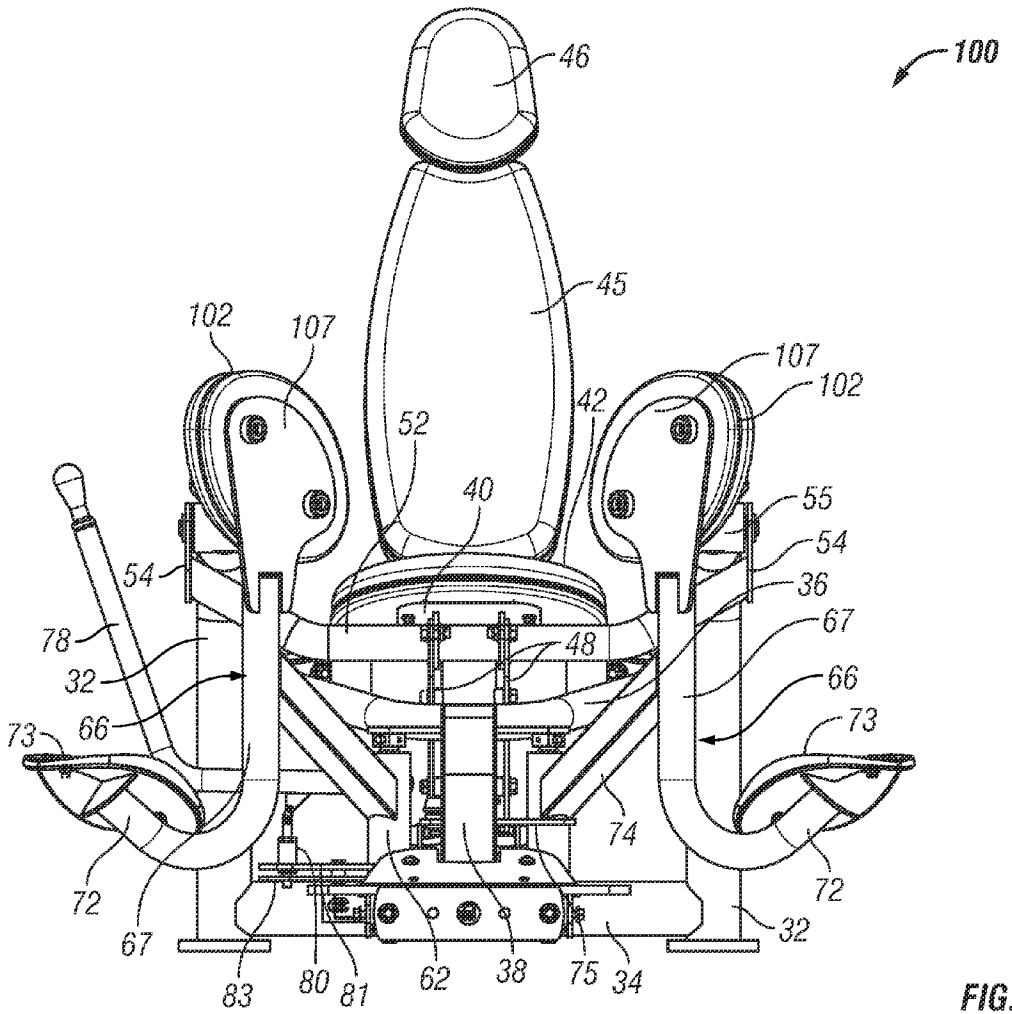
FIG. 13 is a front elevation view of the machine of FIGS. 7 to 12, without the weight stack.
Figure 14:
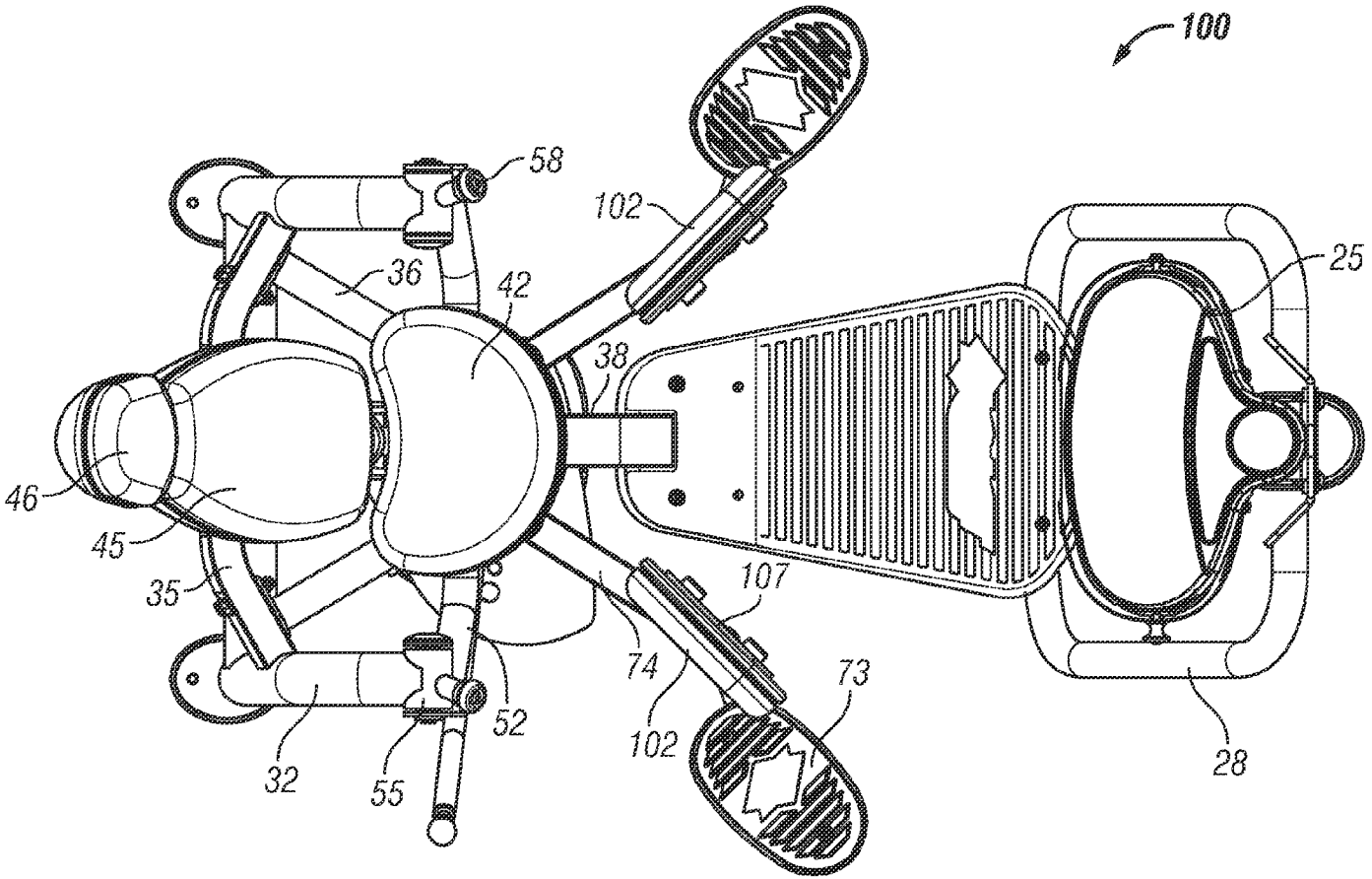
FIG. 14 is a top plan view of the machine of FIGS. 7 to 13.

FIGS. 11 and 12 illustrate only user support or seat assembly 14 (without seat pad 42 or mounting plate 40), the connecting linkages 20, and the exercise arm assemblies 15, with all other parts of machine 100 removed to reveal the details of the connecting linkages 20 and the ROM adjustment system 60. The connecting linkages 20 and ROM system 60 are identical in the outer and inner thigh machines. Seat support strut 52 is omitted in FIG. 11 for clarity, but is included in FIG. 12 to illustrate the seat pivot axis 56. The right hand forward ball joint 106 is tied to a connecting plate 75 which extends from the pivot sleeve 62 of the left hand exercise arm assembly, while the forward ball joint 106 of the left hand connecting linkage 20 is tied to an extension of the first ROM plate 81 associated with the right hand exercise arm assembly 15. Thus, when the ROM lever is adjusted to lift pull pin plunger 82 out of an aligned opening 108 in ROM plate 83 (see FIG. 12), rotation of one of the exercise arms is linked to the other exercise arm via the opposite connecting linkage, the user support, and the second connecting linkage, so that the exercise arms are adjusted in unison to the desired start position. A guide pin 110 extending from first plate 81 engages in slot 112 in ROM plate 83 to define end positions for the arm adjustment.

Figure 7:
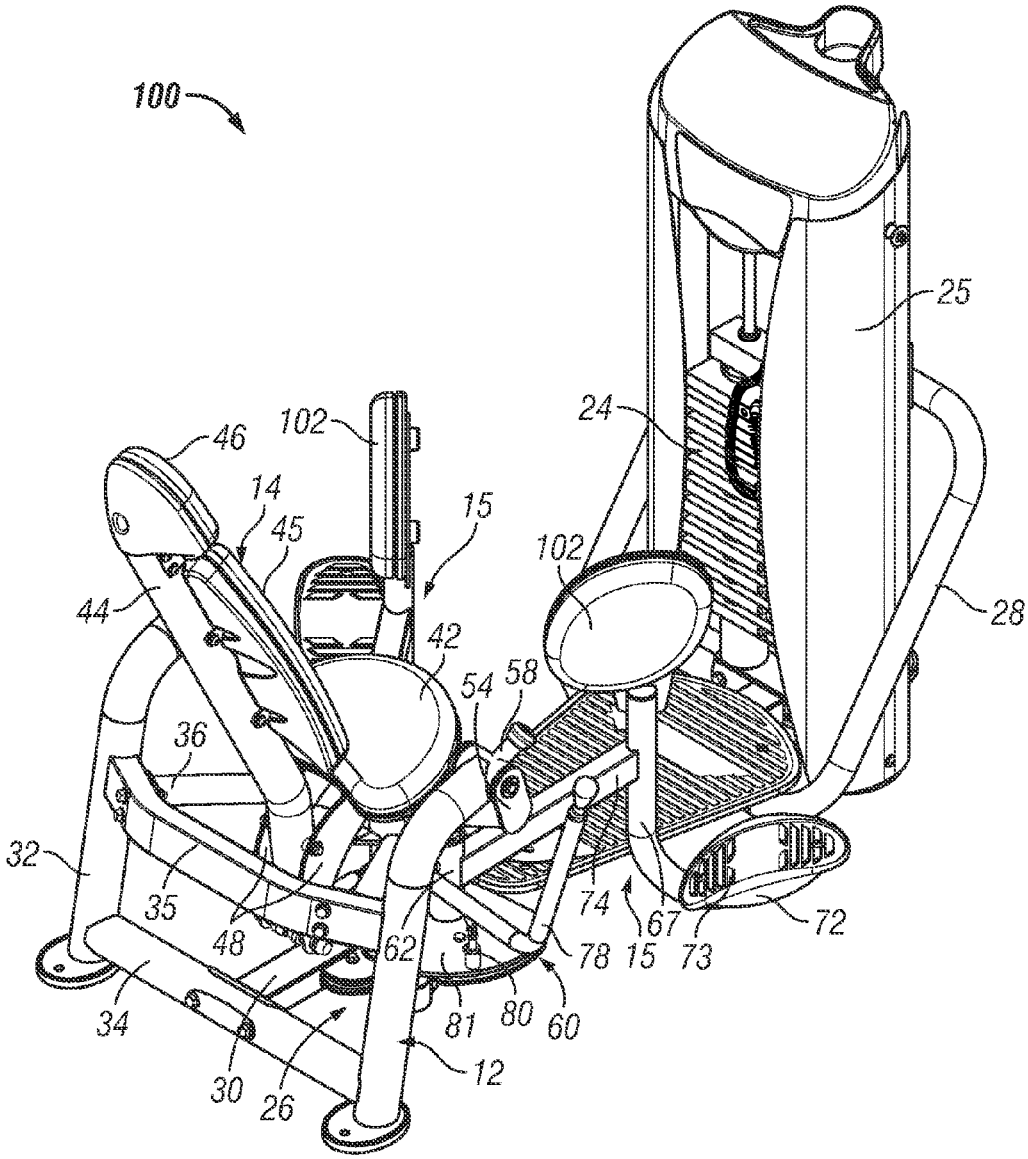
FIG. 7 is a rear perspective view of an inner thigh exercise machine according to a second embodiment, with the machine in a start position for an inner thigh exercise.
Figure 8:
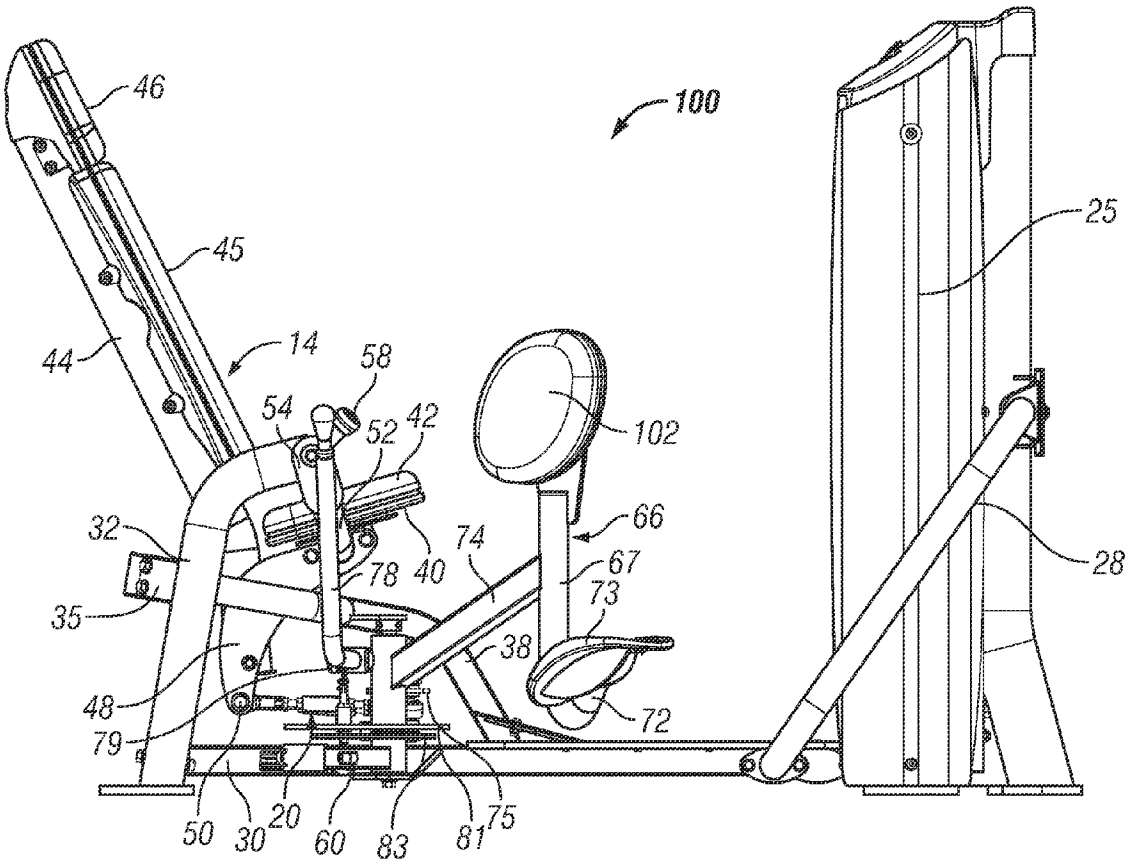
FIG. 8 is a side elevation view of the inner thigh machine in the start position of FIG. 7.
Figure 9:
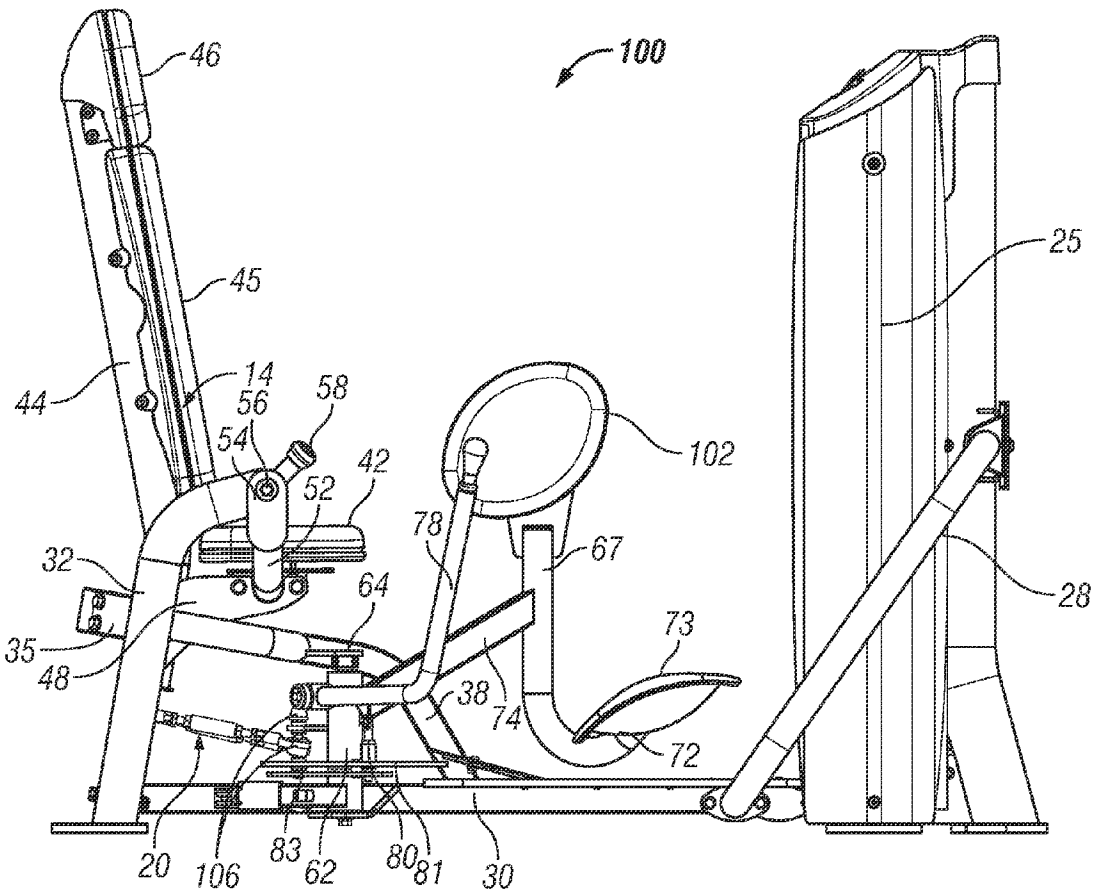
FIG. 9 is a side elevation view similar to FIG. 8 but showing an end position for the inner thigh exercise.
Figure 10:
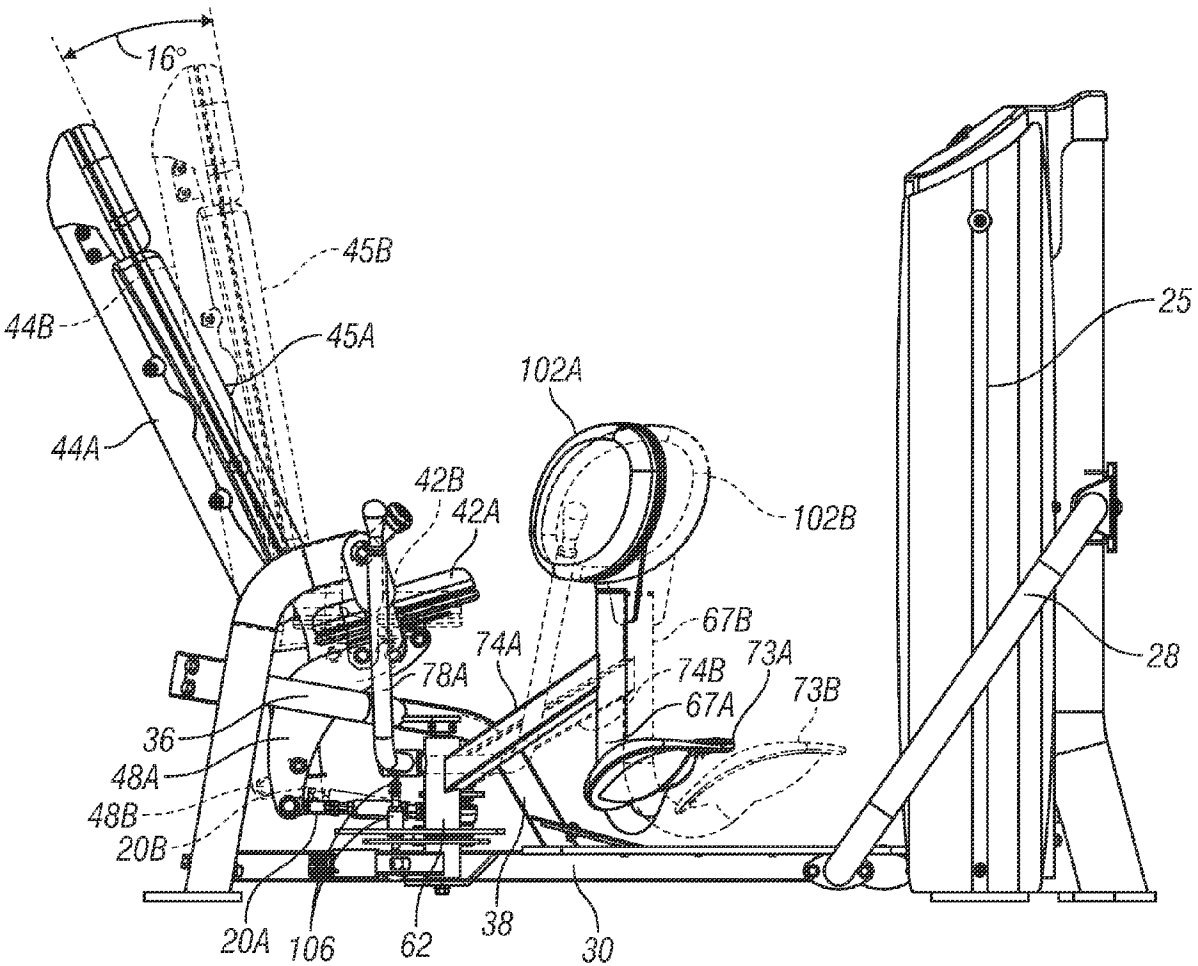
FIG. 10 is a side elevation view showing the two positions of FIGS. 8 and 9 superimposed, to illustrate the movements of the moving parts of the machine during an exercise.

The start position for an inner thigh exercise is illustrated in FIGS. 7 and 8, while the end position is illustrated in FIG. 9. FIG. 10 illustrates the start and end positions superimposed, with part numbers followed by the letter A corresponding to the start position for an inner thigh exercise and part numbers followed by the letter B corresponding to the end position of the part. As illustrated in FIGS. 7 and 8, the exercise starts with the user support 14 in the rearwardly reclined position and the exercise arms 66 rotated outwards about pivot axes 65. The user sits on the user support 14 with their legs spread wide and their inner thighs engaging the thigh pads 102 and their feet on foot rests 73. They then adjust the starting position or pre-stretch of the exercise arm assemblies if desired, by using the ROM adjustment system 60 in the same way as described above for the outer thigh exercise machine. The user then starts the exercise by squeezing their legs together. As the exercise arms move together, the corresponding rotation of the pivot sleeves 62 pushes the connecting linkages 20 rearward, simultaneously rotating pivot plates 48 and the attached user support about pivot axes 56 in a clockwise direction, returning the user support to a more upright position as illustrated in FIG. 9. As in the previous embodiment, the user is in a more reclined position when their legs are spread apart, and in the case of the inner thigh exercise, they move from this position to a more upright position as the legs are brought together, making the exercise more natural feeling and comfortable for the user.

As illustrated in FIG. 10, the inner thigh exercise is exactly the opposite of the outer thigh exercise of FIGS. 1 to 6, with the parts moving from solid line positions which are the same as the dotted line positions in FIG. 4 into dotted line end positions which are the same as the solid line start positions of FIG. 4. Rotation of exercise arms 66 and attached pivot sleeves 62 about vertical pivot axes 65 pushes the connecting linkage back from position 20A to position 20B of FIG. 10, which in turn rotates the pivot plates 48 from position 48A to position 48B, moving the user support seat pad 42 and back pad 45 from reclined start positions 42A and 45A into end position 42B, 45B. As in the previous embodiment, the back rest moves through an angle of around 16 degrees between position 45A and 45B.

Figure 15:
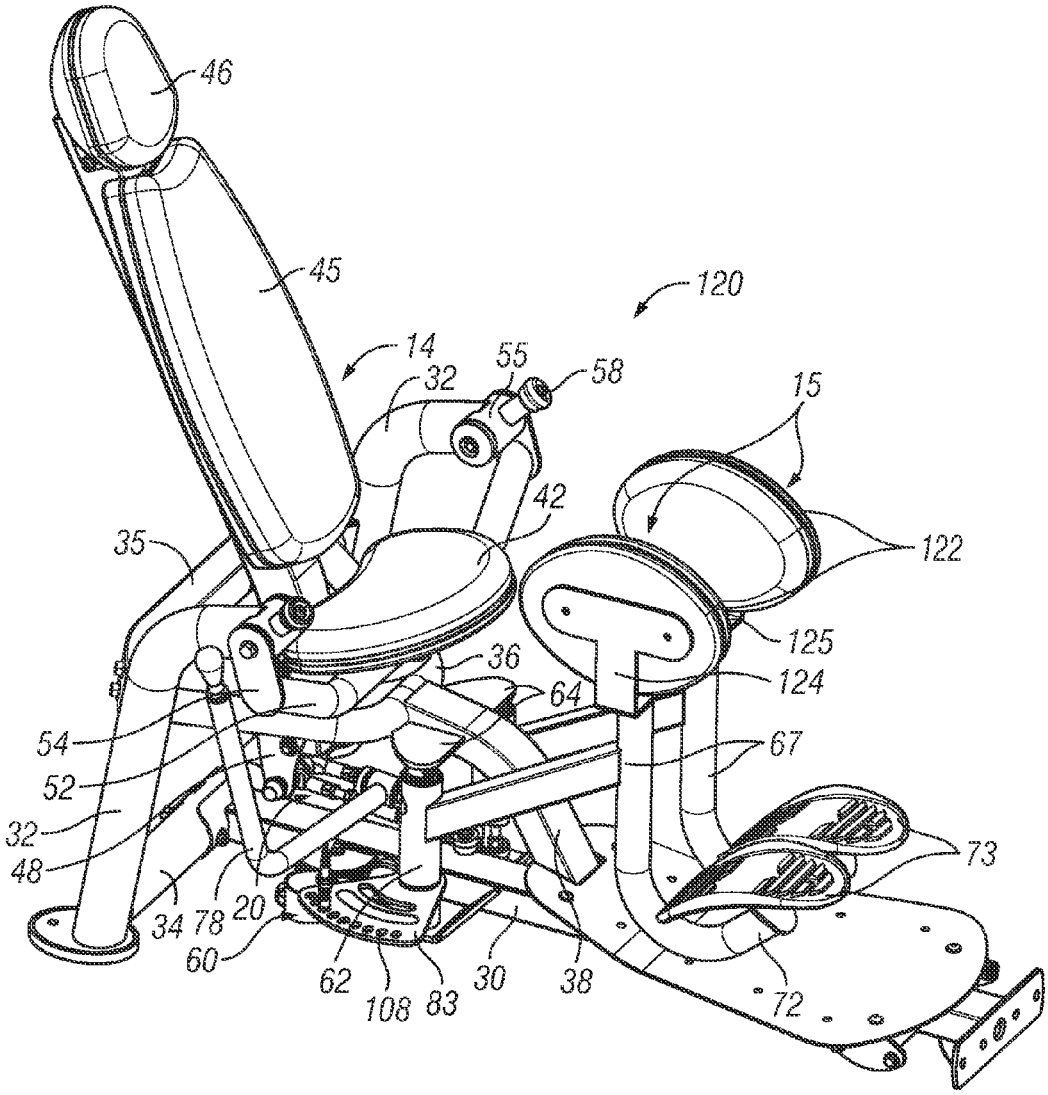
FIG. 15 is a front perspective view of a combined inner and outer thigh exercise machine similar to the machines of FIGS. 1 to 14 apart from the swivel mounted thigh pads, omitting parts of the frame and the weight stack for clarity, with the machine shown in a start position for an outer thigh exercise.
Figure 16:
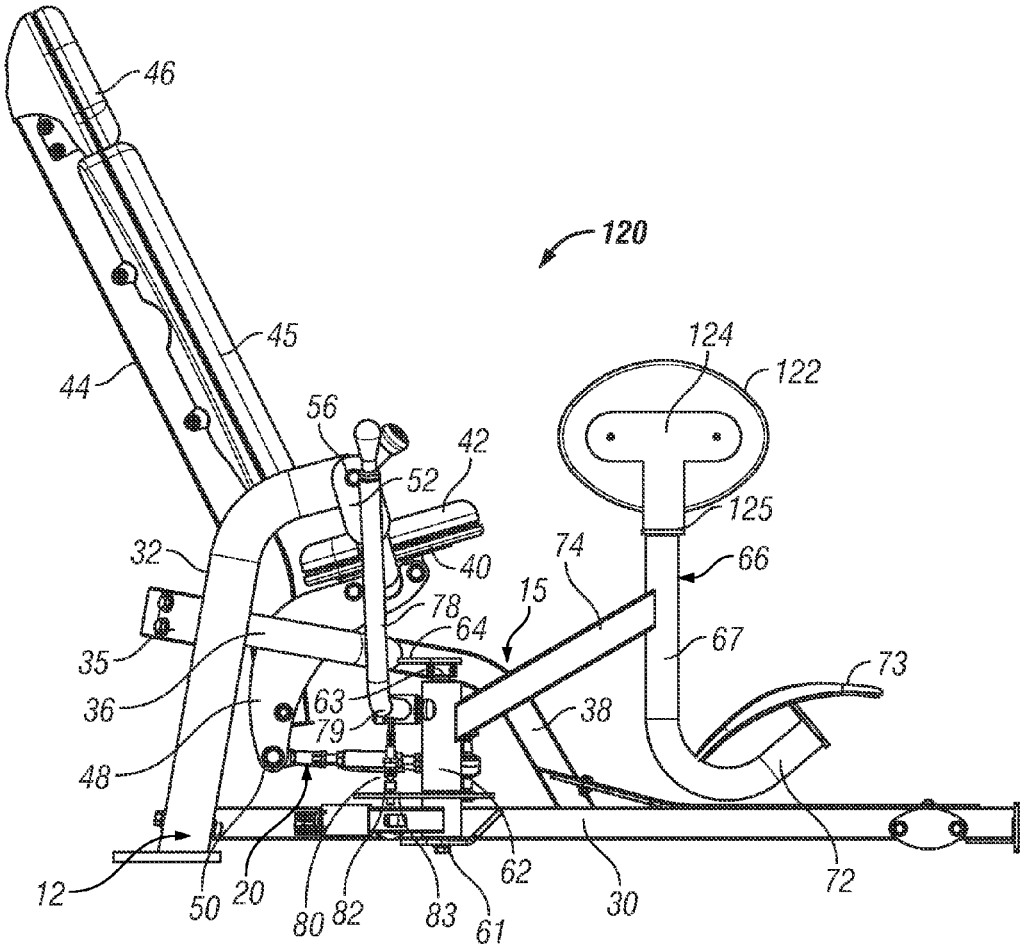
FIG. 16 is a side elevation view of the combined machine in the position of FIG. 15.
Figure 17:
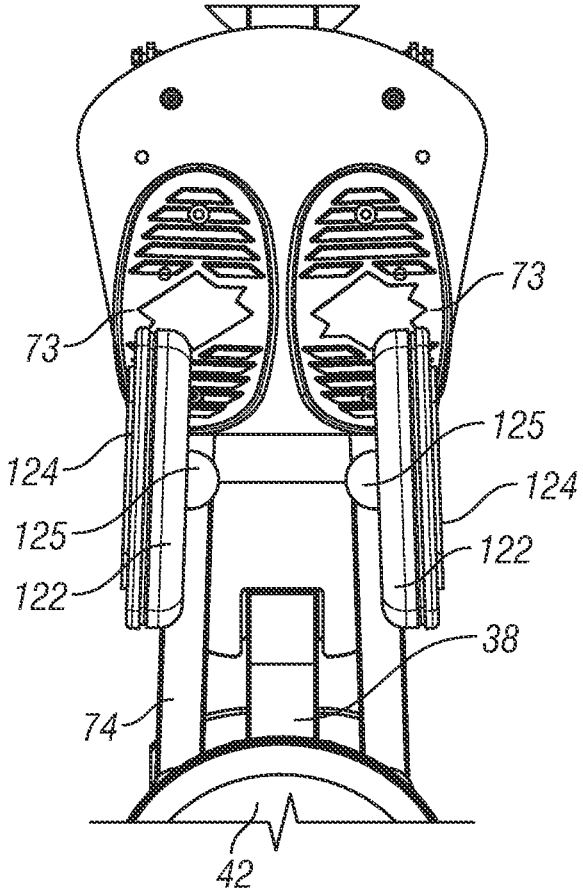
FIG. 17 is a top plan view of the ends of the exercise arms of the machine of FIGS. 15 and 16, including the thigh engaging pads, in the outer thigh mode start position.
Figure 18:
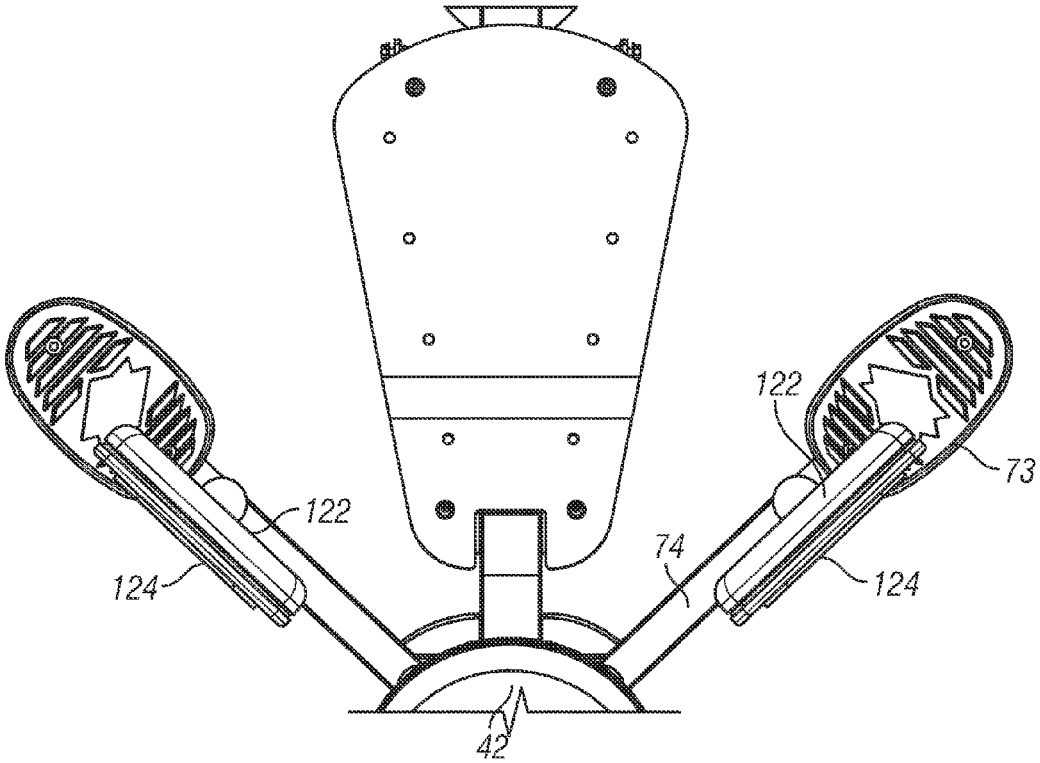
FIG. 18 is a top plan view similar to FIG. 17, illustrating an end position for an outer thigh exercise.
Figure 19:
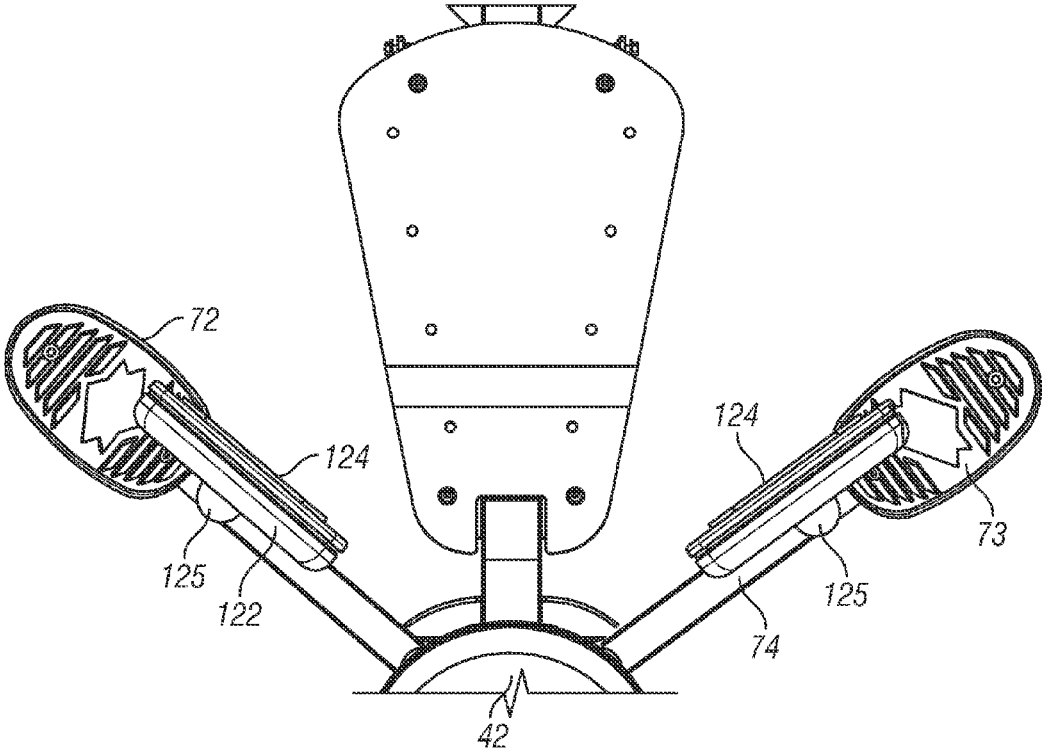
FIG. 19 is a top plan view similar to FIG. 18, but illustrating a start position for an inner thigh exercise with the thigh engaging pads swiveled into the inner thigh mode.
Figure 20:
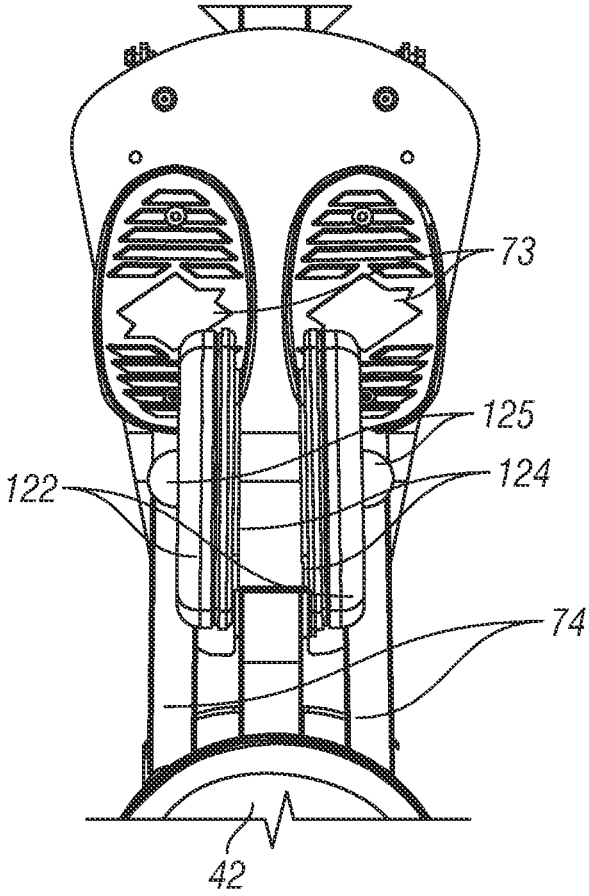
FIG. 20 is a top plan view with the thigh engaging pads in the inner thigh mode, illustrating the end position for the inner thigh exercise.

FIGS. 15 and 16 illustrate a combination inner and outer thigh machine 120 according to a third embodiment. FIGS. 17 and 18 illustrate the exercise arm movement for an outer thigh exercise using the machine of FIGS. 15 and 16, and FIGS. 19 and 20 illustrate exercise arm movement for an inner thigh exercise, with some parts of the machine removed for clarity. Machine 120 is very similar to the individual inner thigh machine 10 and outer thigh machine 100, with the only differences being that the user engaging thigh pads 122 are swivel mounted on exercise arms 66 versus stationary mounted, and the exercise arms are bi-directional, i.e. exercise movement in either direction is resisted by the exercise resistance. The bi-directional exercise resistance can be provided in any conventional manner, for example as described for a combination leg curl/leg extension exercise machine in U.S. Pat. No. 7,563,209, the contents of which are incorporated herein by reference. Other parts of machine 120 are identical to corresponding parts in the previous embodiments, and like reference numbers are used for like parts as appropriate. Some parts of the machine have been removed in FIGS. 15 and 16 for clarity, specifically the weight stack housing and the upper ROM adjuster plate 81, so as to better show the range of motion adjustment plate 83 which is hidden in the drawings of the first two embodiments.

In the combination machine 120, a swiveling pad mounting plate 124 is rotatably mounted at the top of each upright exercise arm portion 67 via swivel mount 125, and a respective thigh engaging pad 122 is secured to each plate 124. The pad is positioned in the first position of FIGS. 15 to 18 with the pads facing inwards in order to perform an outer thigh exercise, and is rotated via swivel mount 125 into the second position of FIGS. 19 and 20 with the pads facing outward in order to perform an inner thigh exercise. Other than the adjustment of the swiveling pads to face inward or outward, the outer thigh exercise and inner thigh exercise are performed in exactly the same way as described above in connection with FIGS. 1 to 7 and FIGS. 8 to 14 respectively. Thus, when a user wants to perform an outer thigh exercise, they rotate the pads into an inwardly facing position and start the exercise with the exercise arms extending forward in the position illustrated in FIG. 17, with their legs extending forward between the pads and their feet engaging foot plates 73. With their outer thighs engaging the pads 122, they push the pads outward into the end position of FIG. 18, while the seat rocks from the upright to the rearwardly reclined position. If a user wants to perform an inner thigh exercise, they rotate the pads 122 into an outwardly facing position with the arms extended outward as in FIG. 19, and then engage the pads with their inner thighs, pushing the pads and exercise arms inwards into the end position of FIG. 20, while the seat rocks forward from the rearwardly reclined position to the upright position.

In each of the above embodiments, movement of the user engagement device or exercise arm assemblies is translated into rocking movement of a user support, making the exercise more enjoyable for the user. Additionally, the linked relationship between the movement of the exercise arms and the movement of the user support in the above embodiments is designed so that movement of the user support tracks movement of the exercise arms and keeps the user in better alignment for engaging the thigh pads, with the user support moving from a more upright position when the legs are close together and a more reclined position when the legs are spread apart, regardless of which of these positions is the exercise start position. The user support rocks rearward as a user performs an outer thigh exercise, pushing the exercise arms outward, and rocks forward as the user performs an inner thigh exercise, pushing the exercise arms inward. This allows the hips to flex and tilt naturally, reducing stress to the muscles in the low back and groin. This provides a more comfortable, better feeling exercise that enhances the user's workout.

It should be understood that all the different elements used in the above embodiments may be mixed and interchanged with one another and still incorporate the essence of the above embodiments. The exercise arms may be mounted on the main frame, user support or connecting link. The connecting links could be made adjustable and the links could be replaced by a cable. Cables could be replaced with belts, ropes, chains, or the like, and pulleys could be replaced with sprockets. The seat and/or back pad could be fixed or made adjustable relative to the supporting frame. Various different types of user engaging pads can be used to engage different parts of the user's legs instead of the thigh engaging pads of the embodiments described above.

The user support pivot mount may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack as in the above embodiments, or may be any other type of resistance known in the art, such as weight plates, elastic bands, or pneumatic, electromagnetic, or hydraulic resistance. The exercise machines may be stand alone machines or may be part of a multi-station gym.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. A thigh exercise machine, comprising:

a stationary main frame having a forward end, a rear end and a central longitudinal axis extending from the forward end to the rear end;

a user support seat pivotally mounted relative to the main frame and adapted to support a user in a seated exercise position, the user support seat being movable from a start position along a user support path during a thigh exercise;

an exercise arm assembly comprising left and right exercise arms movably mounted relative to the main frame on opposite left and right sides of said central longitudinal axis, each exercise arm being configured for inward movement towards the central longitudinal axis and the other exercise arm and outward movement away from the central longitudinal axis and the other exercise arm, each exercise arm having a user engaging portion which is adapted for engagement by a respective leg of the user when the user is supported in an exercise position on the user support seat, at least one of the inward and outward movements defining a thigh exercise movement;

a connecting linkage assembly pivotally connected to at least one of the exercise arms at a first location and pivotally connected to the user support seat at a second location spaced from the first location, whereby movement of the at least one exercise arm is linked to movement of the user support seat, the connecting linkage assembly being configured to position the user support seat in a first, reclined orientation when the exercise arms are each moved outwardly, away from one another and the central longitudinal axis, and to position the user support seat in a second, reclined orientation which is less reclined than said first, reclined orientation when the exercise arms are moved inwardly, towards one another and the central longitudinal axis; and a load which resists movement of at least one of the exercise arm assembly, the user support seat, and the connecting linkage assembly.

2. The machine of claim 1, wherein the user support seat has primary and secondary supports which support spaced positions on a user's body throughout the exercise, the primary and secondary supports moving together throughout the exercise movement.

3. The machine of claim 2, wherein the primary support comprises a seat pad and the secondary support comprises a back pad.

4. The machine of claim 3, further comprising handles secured to the seat and configured for gripping by a user during a thigh exercise.

5. The machine of claim 1, wherein the main frame has a base, each exercise arm comprises a generally upright member having an upper portion and a lower portion extending in a generally downward direction towards the base, and the user engaging portion comprises a thigh engaging pad mounted on the upper portion.

6. The machine of claim 5, wherein the upright member further comprises a forward portion extending forward from the lower portion, and a foot plate mounted on the forward portion and configured for engagement by a respective foot of the user.

7. The machine of claim 5, further comprising a swiveling mounting plate rotatably mounted at the upper portion of the exercise arm, the thigh engaging pad being mounted on the mounting plate, and the mounting plate being rotatable between a first position in which the thigh engaging pad faces inwards for engagement by a user performing an outer thigh exercise and a second position in which the thigh engaging pad faces outwards for engagement by a user performing an inner thigh exercise.

8. The machine of claim 1, further comprising a left pivot mount and a right pivot mount on the main frame, the left exercise arm being pivotally mounted on the left pivot mount for inward and outward movement about a first pivot axis and the right exercise arm being pivotally mounted on the right pivot mount for inward and outward movement about a second pivot axis.

9. The machine of claim 8, further comprising a range of motion (ROM) adjustment mechanism associated with one of the exercise arms, the ROM adjustment mechanism being configured for adjustment of an exercise start position of the exercise arms relative to the main frame.

10. The machine of claim 8, wherein the first and second pivot axes are parallel, vertical axes.

11. The machine of claim 1, wherein the user support seat is pivotally mounted on the main frame for rotation about a horizontal user support pivot axis during a thigh exercise.

12. The machine of claim 11, wherein the user support pivot axis is located below the seat.

13. The machine of claim 1, wherein the user engaging portion of each exercise arm faces inward and is configured for engagement by an outer portion of a user's leg when the user is positioned on the user support seat, and the exercise arms are configured to move from an inner to an outer position corresponding to an outer thigh exercise movement.

14. The machine of claim 1, wherein the user engaging portion of each exercise arm faces outward and is configured for engagement by an inner portion of a user's leg when the user is positioned on the user support, and the exercise arms are configured to move from an outer to an inner position corresponding to an inner thigh exercise movement.

15. The machine of claim 1, wherein the user engaging portion of each exercise arm is rotatably mounted and configured for rotation between inwardly and outwardly facing positions for performance of outer and inner thigh exercises, respectively.

16. The machine of claim 1, wherein each user engaging portion is a thigh engagement pad configured for engagement by a user's thigh.

17. The machine of claim 1, wherein the user support pivots through an angle of approximately sixteen degrees between the start position and an end position of a thigh exercise.

18. The machine of claim 1, wherein he exercise arms are linked to the load.

19. The machine of claim 1, wherein the connecting linkage assembly extends between both exercise arms and the user support seat and is configured to link movement of the exercise arms to movement of the user support seat.

20. A thigh exercise machine, comprising:

a stationary main frame having a forward end, a rear end and a central longitudinal axis extending from the forward end to the rear end;

a user support seat pivotally mounted relative to the main frame and adapted to support a user in an exercise position, the user support seat being movable from a start position along a user support path during a thigh exercise;

an exercise arm assembly comprising left and right exercise arms movably mounted relative to the main frame on opposite left and right sides of said central longitudinal axis, each exercise arm having spaced first and second user engaging portions which are adapted for engagement by spaced positions on a respective leg of the user when the user is supported in an exercise position on the user support seat, the left and right exercise arms being configured for inward and outward movement relative to the central longitudinal axis towards and away from each other, at least one of the inward and outward movements defining a thigh exercise movement;

a connecting linkage assembly between at least one of the exercise arms and the user support seat which links movement of the at least one exercise arm to movement of the user support seat;

a load which resists movement of at least one of the exercise arm assembly, the user support seat, and the connecting linkage assembly; and each first user engaging portion comprising a thigh engagement pad configured for engagement by a respective thigh of a user and each second user engaging portion comprising a foot support configured for engagement by a respective foot of a user during a thigh exercise.

21. A thigh exercise machine, comprising:

a stationary main frame having a forward end, a rear end and a central longitudinal axis extending from the forward end to the rear end;

a user support seat pivotally mounted relative to the main frame and adapted to support a user in an exercise position, the user support seat being movable from a start position along a user support path during a thigh exercise;

an exercise arm assembly comprising left and right exercise arms movably mounted relative to the main frame, each exercise arm having a user engaging portion which is adapted for engagement by a respective leg of the user when the user is supported in an exercise position on the user support seat, the left and right exercise arms being configured for inward and outward movement relative to the central longitudinal axis towards and away from each other, at least one of the inward and outward movements defining a thigh exercise movement;

a connecting linkage assembly between the exercise arms and the user support seat which links movement of the exercise arms to movement of the user support seat;

the connecting linkage assembly comprising a first connecting linkage between the left exercise arm and the user support seat and a second connecting linkage between the right exercise arm and the user support seat; and a load which resists movement of at least one of the exercise arm assembly, the user support seat, and the connecting linkage assembly.

22. The machine of claim 21, wherein the user support seat is pivotally connected to the first and second connecting linkage.

23. The machine of claim 22, wherein each connecting linkage is pivotally connected to the user support at a first location and pivotally connected to the respective exercise arm at a second location spaced forward from the first location, whereby outward movement of the exercise arms pulls the respective connecting linkages forwards.

24. The machine of claim 23, further comprising first and second pivot brackets which extend downward from the user support seat, each connecting linkage having a first pivot connection to a respective pivot bracket at a location spaced below the user support seat, whereby the user support seat pivots rearward in response to outward movement of the exercise arms.

25. The machine of claim 24, wherein the first pivot connections are ball joints.

26. The machine of claim 21, wherein the first connecting linkage comprises a right hand connecting linkage, the second connecting linkage comprises a left hand connecting linkage, the left exercise arm is pivotally linked to the right hand connecting linkage and the right exercise arm is pivotally linked to the left hand connecting linkage.

27. The machine of claim 26, wherein each connecting linkage has a rear pivot connection linked to the user support seat and a forward pivot connection linked to the respective exercise arm.

28. The machine of claim 27, further comprising a first pivot link pivotally connected between the left exercise arm and right hand connecting linkage and a second pivot link pivotally connected between the right exercise arm and left hand connecting linkage and crossing over the first pivot link.

29. The machine of claim 27, wherein the front and rear pivot connection are ball joints.

30. A thigh exercise machine, comprising:

a stationary main frame having a forward end, a rear end and a central longitudinal axis extending from the forward end to the rear end;

a user support seat pivotally mounted relative to the main frame and adapted to support a user in an exercise position, the user support seat being movable from a start position along a user support path during a thigh exercise;

an exercise arm assembly comprising left and right exercise arms movably mounted relative to the main frame, each exercise arm having a user engaging portion which is adapted for engagement by a respective leg of the user when the user is supported in an exercise position on the user support seat, the left and right exercise arms being configured for inward and outward movement relative to the central longitudinal axis towards and away from each other, at least one of the inward and outward movements defining a thigh exercise movement;

a connecting linkage assembly between at least one of the exercise arms and the user support seat which links movement of the at least one exercise arm to movement of the user support seat;

the connecting linkage assembly comprising a first connecting linkage between the left exercise arm and the user support seat and a second connecting linkage separate from the first connecting linkage between the right exercise arm and the user support seat the first connecting linkage comprising a right hand connecting linkage, the second connecting linkage comprising a left hand connecting linkage, the left exercise arm being pivotally linked to the right hand connecting linkage and the right exercise arm being pivotally linked to the left hand connecting linkage each connecting linkage having a rear pivot connection linked to the user support seat and a forward pivot connection linked to the respective exercise arm;

a first pivot link pivotally connected between the left exercise arm and right hand connecting linkage and a second pivot link pivotally connected between the right exercise arm and left hand connecting linkage and crossing over the first pivot link;

a range of motion adjustment mechanism (ROM) configured for adjusting the exercise start position of the exercise arms, one of the pivot links comprising part of the ROM adjustment mechanism, whereby operation of the ROM adjustment mechanism adjusts the start position of both exercise arms; and a load which resists movement of at least one of the exercise arm assembly, the user support seat, and the connecting linkage assembly.

31. The machine of claim 30, wherein the ROM adjustment mechanism further comprises a range of motion plate (ROM) having a series of spaced openings defining different start positions, and a pull pin releasably engageable in a selected opening to secure said one pivot link to the ROM plate.

* * * * *